US011585115B2

(12) United States Patent
Chen et al.

(10) Patent No.: US 11,585,115 B2
(45) Date of Patent: Feb. 21, 2023

(54) SMALL-ANGLE LATCH SYSTEM FOR A LOCK

(71) Applicant: BEST ACCESS SOLUTIONS, INC., Indianapolis, IN (US)

(72) Inventors: Steven M. C. Chen, Chiayi (TW); Sam P. Y. Chen, Chiayi (TW); Newman C. W. Lai, Chiayi (TW)

(73) Assignee: dormakaba USA Inc., Indianapolis, IN (US)

( * ) Notice: Subject to any disclaimer, the term of this patent is extended or adjusted under 35 U.S.C. 154(b) by 835 days.

(21) Appl. No.: 15/864,136

(22) Filed: Jan. 8, 2018

(65) Prior Publication Data

US 2018/0195312 A1 Jul. 12, 2018

Related U.S. Application Data

(60) Provisional application No. 62/443,412, filed on Jan. 6, 2017.

(51) Int. Cl.

| | |
|---|---|
| ***E05B 1/00*** | (2006.01) |
| ***E05B 9/02*** | (2006.01) |
| ***E05C 1/12*** | (2006.01) |
| ***E05B 55/00*** | (2006.01) |

(52) U.S. Cl.

CPC ..... *E05B 1/0053* (2013.01); *E05B 9/02* (2013.01); *E05B 55/005* (2013.01); *E05C 1/12* (2013.01)

(58) Field of Classification Search

CPC ..... E05B 1/0053; E05B 9/02; E05B 55/005; E05B 63/10; E05C 1/12; Y10T 292/1016; Y10T 292/0977; Y10T 292/097; Y10T 292/57; Y10T 292/59; Y10T 292/62; Y10T 292/93; Y10T 292/96; Y10S 292/30; Y10S 292/52

See application file for complete search history.

(56) References Cited

U.S. PATENT DOCUMENTS

| | | | | |
|---|---|---|---|---|
| 2,644,705 A * | 7/1953 | Hagstrom | ..... | E05B 55/12 292/169.13 |
| 2,980,463 A | 4/1961 | Russell et al. | | |
| 2,982,574 A | 5/1961 | Von Sternberg | | |
| 3,441,269 A * | 4/1969 | Doyle | ..... | E05B 55/005 292/165 |

(Continued)

FOREIGN PATENT DOCUMENTS

TW 201738451 A 11/2017

OTHER PUBLICATIONS

International Preliminary Report on Patentability received for PCT Patent Application No. PCT/US2018/012787, dated Jul. 18, 2019, 9 pages.

(Continued)

*Primary Examiner* — Christine M Mills
*Assistant Examiner* — Yahya Sidky
(74) *Attorney, Agent, or Firm* — Faegre Drinker Biddle & Reath LLP

(57) ABSTRACT

A small angle latch is disclosed which moves a latch bolt from a fully extended position to a retracted position wherein the latch bolt is substantially flush with an outer surface of a faceplate through a rotation of an input device, such as a lever, in the range of from about 25 degrees to about 35 degrees, without exceeding a maximum torque upon the input member of 28 inch-pounds.

33 Claims, 16 Drawing Sheets

(56) References Cited

U.S. PATENT DOCUMENTS

| | | | | |
|---|---|---|---|---|
| 3,606,425 | A * | 9/1971 | James | E05C 1/163 292/173 |
| 4,623,174 | A | 11/1986 | Trull et al. | |
| 4,711,477 | A * | 12/1987 | Fann | E05B 63/06 292/1.5 |
| 5,690,372 | A * | 11/1997 | Jans | E05B 63/0021 292/169 |
| 6,688,660 | B2 * | 2/2004 | Huang | E05B 63/06 292/1.5 |
| 6,860,529 | B2 * | 3/2005 | Chong | E05B 13/002 292/169.18 |
| 7,717,480 | B2 * | 5/2010 | Fan | E05C 1/163 292/1.5 |
| 8,066,309 | B2 * | 11/2011 | Bartos | E05C 1/163 292/337 |
| 10,066,420 | B2 * | 9/2018 | Cheng | E05C 1/163 |
| 2019/0100940 | A1 | 4/2019 | Imanuel et al. | |

OTHER PUBLICATIONS

International Search Report and Written Opinion received for PCT Patent Application No. PCT/US2018/012787, dated Mar. 6, 2018, 10 pages.

Office Action received for Taiwan Patent Application No. 107100678, dated Jul. 13, 2021, 6 pages (Original Document Only).

* cited by examiner

SMALL-ANGLE LATCH SYSTEM FOR A LOCK

RELATED APPLICATION

This application claims the benefit of U.S. Provisional Patent Application No. 62/443,412, filed Jan. 6, 2017, titled SMALL-ANGLE LATCH SYSTEM FOR A LOCK, the entire disclosure of which is expressly incorporated by reference herein.

BACKGROUND

Field

The present invention relates to latches for locks and handlesets, and particularly to latch systems that are operated by rotating a lever of the lock or handleset.

Description of the Related Art

It is desirable to minimize the angle through which the handle of a lock or handleset (hereinafter, collectively "lock") must be rotated to fully retract the latch bolt. This is particularly important where the handle is a lever, as opposed to a knob. That's because lever-actuated locks can provide increased ease of access for persons with disabilities and for the elderly. However, for certain conventional entrance locks, the lever must be rotated at least 52 degrees to fully retract the latch bolt. Accordingly, as the demand grows for better access solutions, it becomes important to minimize the rotational stress placed on a person's wrist to open a door, and that means minimizing the angle through which the lever must be rotated. However, as can be appreciated, if the handle is a knob, this goal becomes even more important, in view of the stresses that a knob places on a wrist.

Conventional tubular latch systems couple the lever to a latch member, which in turn is coupled directly or indirectly to the latch bolt. Rotating the lever retracts the latch member, which in turn retracts the latch bolt. More particularly, in one conventional latch system, a convex cam member is disposed between the lever and the latch member so that the centers of rotation of the lever and cam member are coincident, and so that the center of rotation is spaced from the axis of reciprocation of the latch member. A pivoting drive member is disposed between the latch member and the latch bolt. During operation, a 52 degrees rotation of the lever causes the convex earn member to rotate about 38 degrees, which in turn causes the latch member to pivot the drive member through an angle of about 39 degrees. These elements cooperate to move the latch bolt to its fully-retracted position, a distance of about 12 mm. However, this conventional system also produces about 2 degrees of idle or lost-motion cam rotation before the convex cam member engages the latch member, thereby adding to the total amount of lever rotation required to withdraw the bolt to its retracted position.

To achieve this leverage, the coincident centers of rotation of the lever and cam member, relative to the latch member, are disposed almost midway between the total amount of horizontal travel of the points of contact of the cam with the latch member required to fully retract the latch bolt. Accordingly, in the latch system of this conventional entrance lock assembly, a drive vector drawn from the center of rotation of the lever/cam member to the point at which the convex cam surface engages the latch member, will rotate through a total angle of about 38°, passing through the point at which the drive vector is perpendicular to the axis of reciprocation of the latch member. This causes a portion of the total angular distance traversed by the drive vector to lie to the right of the point at which the drive vector is perpendicular to the axis of reciprocation.

The configuration noted above guarantees that the conventional latch system will exhibit a relatively high mechanical advantage, while requiring a relatively low amount of torque to be exerted upon the lever to achieve full retraction of the latch bolt, both of which attributes to date have been accepted as engineering best practices by engineers designing these types of latch systems. Furthermore, engineers are mindful of an upper limit on the amount of torque needed to rotate a lever to achieve full retraction of the latch bolt. The ANSI/BHMA Standard A 156.2-2011, for bored and preassembled locks and latches, Section 9.1, "Force to Retract Unloaded Bolt", limits the maximum torque on the lever to 28 inch-pounds.

Thus, with the restrictions discussed above in mind, the issue becomes: how does one significantly reduce the lever or knob rotation angle in the conventional latch system discussed above, in the face of the following additional constraints:

(a) keeping the same lock/latch envelope or footprint as the conventional system so that no significant re-tooling of the lock components need be made;
(b) causing the latch member to be horizontally translated approximately the same distance within the latch assembly as in the conventional system;
(c) keeping substantially the same configuration of the pivoting drive member; and
(d) never exceeding 28 inch-pounds of torque on the lever.

SUMMARY

In an exemplary embodiment of the present disclosure, a latch system is provided. The latch system is adapted to be drivingly connected to an input member of a lock assembly. The latch system comprising a latch bolt housing defining an axis of reciprocation; a faceplate coupled to the latch bolt housing, the faceplate having a latch bolt opening which intersects the axis of reciprocation; a latch bolt having a latch bolt tip, the latch bolt being moveably disposed in the latch bolt housing for reciprocating movement along the axis of reciprocation; and a latch drive system adapted to couple the input member of the lock assembly to the latch bolt to move the latch bolt along the axis of reciprocation. The latch drive system including a cam adapted to be connected for rotation with the input member, the cam rotating about an axis of rotation, the cam having an outer perimeter including a concave portion, a latch member disposed for reciprocating movement along the axis of reciprocation, the latch member including at least one protuberance positioned to be engaged with the cam, a drive member disposed in the latch bolt housing, the drive member having a convex portion arranged to be engaged by a portion of the latch member to pivot the drive member relative to the latch bolt housing, the portion of the latch member being positioned between the drive member and the faceplate, and a latch bolt extension coupled to the latch bolt, the latch bolt extension having an arm positioned to be engaged by the drive member. The latch system having a rest configuration wherein the latch bolt is positioned in a fully extended position with the latch bolt tip extending a first distance from an outer surface of the faceplate in a direction away from the axis of rotation and an actuated configuration wherein in response to a system torque on the input member of the lock assembly the latch bolt tip moves towards the axis of rotation to a retracted position substantially flush with the outer surface of the faceplate. The protuberance of the latch member contacting the concave portion of the perimeter of the cam member as the latch bolt moves from the extended position to the retracted position. The latch drive system moves the latch bolt from the extended position to the retracted position when the cam is rotated about the axis of rotation through a first angle of up to about 21 degrees.

In one example thereof, the protuberance of the latch member contacts the perimeter of the cam when the latch system is in the rest configuration. In another example thereof, the protuberance of the latch member contacts the perimeter of the cam throughout the rotation of the cam through the first angle.

In a further example thereof, the cam includes a cam aperture having a cam aperture perimeter surrounding the axis of rotation, the cam aperture having a cam rotation radius, the concave portion of the perimeter of the cam having a constant cam radius, a ratio of the cam radius of the concave portion of the perimeter of the cam to the cam rotation radius is at least 85%. In a variation thereof, the ratio of the cam radius of the concave portion of the perimeter of the cam to the cam rotation radius is at least 90%. In another variation thereof, the ratio of the cam radius of the concave portion of the perimeter of the cam to the cam rotation radius is about 100%.

In yet another example, the concave portion of the perimeter of the cam has a variable radius. In still another example, the first angle is in a range of from about 18 degrees to about 21 degrees.

In still yet another example, the movement of the latch bolt from the extended position to the retracted position is in response to a rotation of the input member of the lock assembly through a second angle in a range of about 25 degrees to about 35 degrees. In a variation thereof, a system torque of up to 28 inch-pounds upon the input member of the lock system is applied to result in the rotation of the input member of the lock assembly through the second angle. In a further variation thereof, the second angle is about 25 degrees. In still a further variation thereof, the second angle is about 32 degrees.

In a further still example, the latch system further comprises a latch case connected to the latch bolt housing, the latch drive system disposed on the latch case. In a variation thereof, the latch case includes an opening, the cam extending through the opening of the latch case when the latch system is in the actuated configuration. In another variation thereof, a first component of the lock assembly contacts a second component of the lock assembly to prevent the cam from contacting an edge of the opening in the latch case, the first component of the lock assembly being spaced apart from the second component of the lock assembly when the latch system is in the rest configuration.

In yet still a further example thereof, the input member rotates about the axis of rotation defined by the cam.

In yet another example thereof, the perimeter of the cam contacts the protuberance of the latch member when the latch system is in the rest configuration at an initial point of contact, a drive vector passing through the axis of rotation and the initial point of contact forms a drive vector angle relative to horizontal in the range of from about 45 degrees to about 50 degrees. In a variation thereof, as the latch system moves to the actuated configuration, the drive vector angle increases. In a further variation thereof, as the latch system moves to the actuated configuration, the drive vector angle remains an acute angle. In still another variation thereof, the concave portion of the perimeter of the cam remains one a first side of a vertical plane passing through the axis of rotation as the latch system moves from the rest configuration to the actuated configuration, the drive member being positioned on the first side of the vertical plane.

In a further still example, the axis of reciprocation is substantially perpendicular to the axis of rotation.

In another still example, the drive member has a generally U-shaped body having a pair of legs and a connecting base connecting a first leg of the pair of legs to a second leg of the pair of legs, the generally U-shaped body including a channel positioned between the pair of legs and having an open end and a closed end opposite the open end. In a variation thereof, the connecting base of the generally U-shaped body bears against a protuberance formed on an interior surface of the latch bolt housing as the drive member pivots relative to the latch bolt housing. In another variation thereof, the convex portion of the drive member includes a first convex bulge disposed on the first leg of the pair of legs and a second convex bulge disposed on the second leg of the pair of legs. In another variation thereof, each of the first convex bulge and the second convex bulge includes a first end and a second end positioned between the first end and the connecting base of the U-shaped body. In still another variation, the second end of the first convex bulge is collinear with the second end of the second convex bulge. In yet still another variation, a length of the first convex bulge from the first end of the first convex bulge to the second end of the first convex bulge is at least 40% of an overall length of the drive member from a tip of the first leg of the generally U-shaped body of the drive member to a lower extreme of the connecting base of the generally U-shaped base, the lower extreme of the connecting base being opposite the channel. In a further still variation, the second convex bulge is identical to the first convex bulge.

In another exemplary embodiment of the present disclosure, a method of retracting a latch bolt for a lock assembly having a rest configuration wherein a latch bolt tip of the latch bolt is fully extended relative to a faceplate of the lock assembly and an actuated configuration wherein the latch bolt tip is substantially flush with the faceplate is provided. The method comprising the steps of providing the lock assembly in the rest configuration; and rotating an input member of the lock assembly in the range of from about 25 degrees to about 35 degrees, without exceeding a maximum torque upon the input member of 28 inch-pounds, to move the latch bolt tip of the latch bolt from the fully extended position relative to the faceplate of the rest configuration to the substantially flush with the faceplate position of the actuated position.

In an example thereof, the step of rotating the input member causes the steps of: rotating a cam of a latch system about an axis of rotation; engaging a perimeter of the cam with a protuberance of a latch member to move a latch member along an axis of reciprocation away from the face plate; engaging a drive member with an end of the latch member to pivot the drive member relative to a latch bolt housing which receives the latch bolt; and engaging a latch bolt extension which is coupled to the latch bolt with the drive member to move the latch bolt extension away from the faceplate along the axis of reciprocation and thereby retract the latch bolt along the axis of reciprocation, wherein a concave portion of the perimeter of the cam and a convex portion of the drive member are sized and arranged to facilitate movement of the latch bolt tip of the latch bolt from the fully extended position to the substantially flush with the faceplate position in response to the rotation of the input member of the lock assembly in the range of from about 25 degrees to about 35 degrees, without exceeding a maximum torque upon the lever of 28 inch-pounds.

The terminology used herein is for the purpose of describing particular embodiments only and is not intended to be limiting of the invention. As used herein, the singular forms, "a," "an" and "the" are intended to include the plural forms as well, unless the context clearly indicates otherwise. It will be further understood that the root terms "include" and/or "have", when used in this specification, specify the presence of stated features, steps, operations, elements, and/or components, but do not preclude the presence or addition of at least one other feature, step, operation, element, component, and/or groups thereof.

As used herein, the terms "comprises:", "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus.

For definitional purposes and as used herein, "connected", "coupled", or "attached" includes physical or electrical, whether direct or indirect, affixed or adjustably mounted, as for example, — . . . the plurality of wiping terminals is operatively connected to the electric circuit." Thus, unless specified, "connected" or "attached—is intended to embrace any operationally functional connection.

As used herein, "substantially," "generally," "slightly" and other words of degree are relative modifiers intended to indicate permissible variation from the characteristic so modified. It is not intended to be limited to the absolute value or characteristic which it modifies but rather possessing more of the physical or functional characteristic than its opposite, and approaching or approximating such a physical or functional characteristic.

In the following description, reference is made to the accompanying drawings which are provided for illustration purposes as representative of specific exemplary embodiments. Given the following description of the specification and drawings, the apparatus and methods should become evident to a person of ordinary skill in the art. Further areas of applicability of the present teachings will become apparent from the description provided herein. It is to be understood that other embodiments can be utilized and that structural changes based on presently known structural and/or functional equivalents can be made without departing from the scope of the invention.

BRIEF DESCRIPTION OF THE DRAWINGS

The above-mentioned and other features and advantages of this invention, and the manner of attaining them, will become more apparent and the invention will be better understood by reference to the following descriptions of embodiments of the invention taken in conjunction with the accompanying drawings, wherein.

Corresponding reference characters indicate corresponding parts throughout the several views. The exemplifications set out herein illustrate embodiments of the present invention, and such exemplifications are not to be construed as limiting the scope of the present invention in any manner.

DETAILED DESCRIPTION OF THE DRAWINGS

Figure 1:
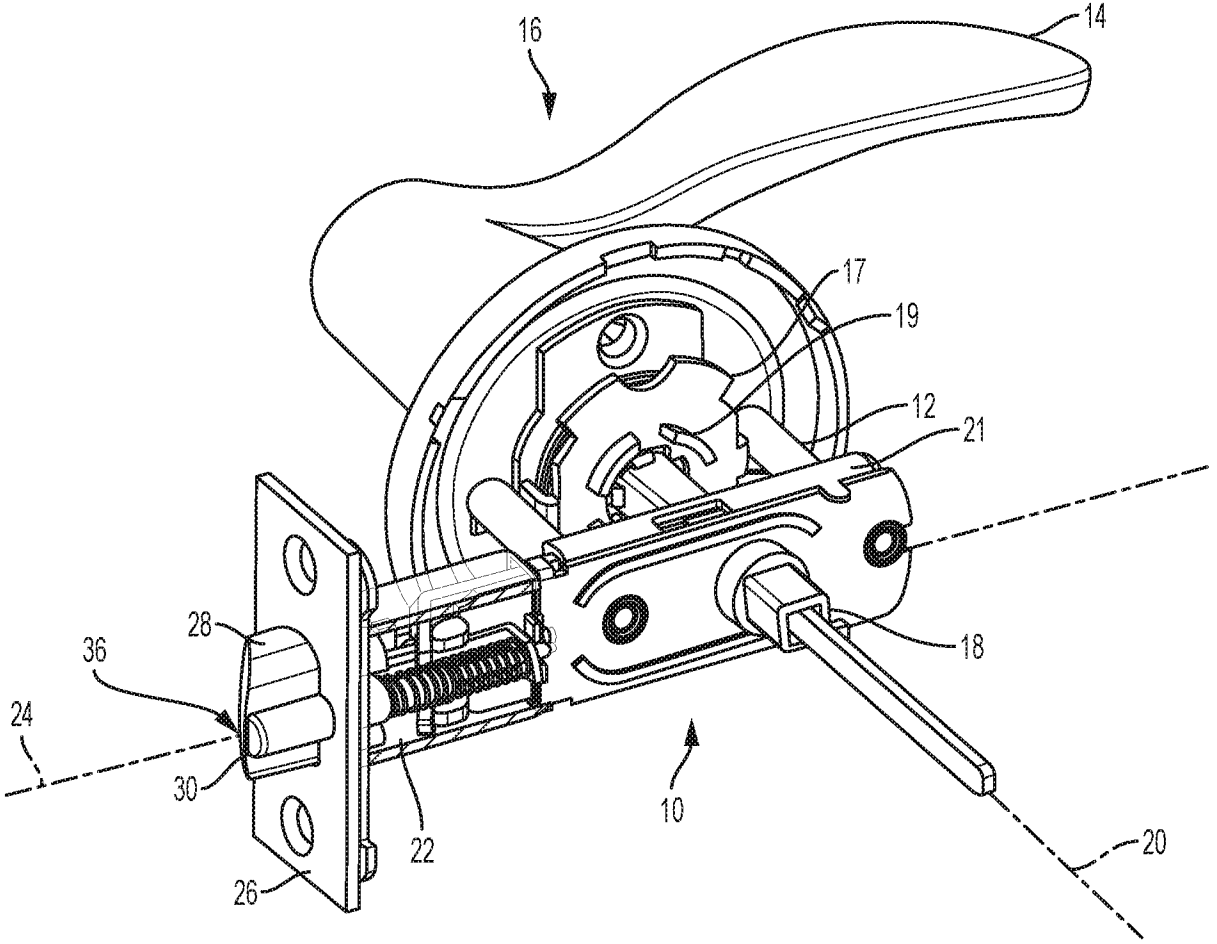
FIG. 1 is a partially cut-away perspective view of one embodiment of a lock assembly embodying the small-angle latch system of the present invention, with the lever shown at rest and the latch system in the rest configuration which corresponds to the absence of external force on an input member of the lock assembly.
Figure 2:
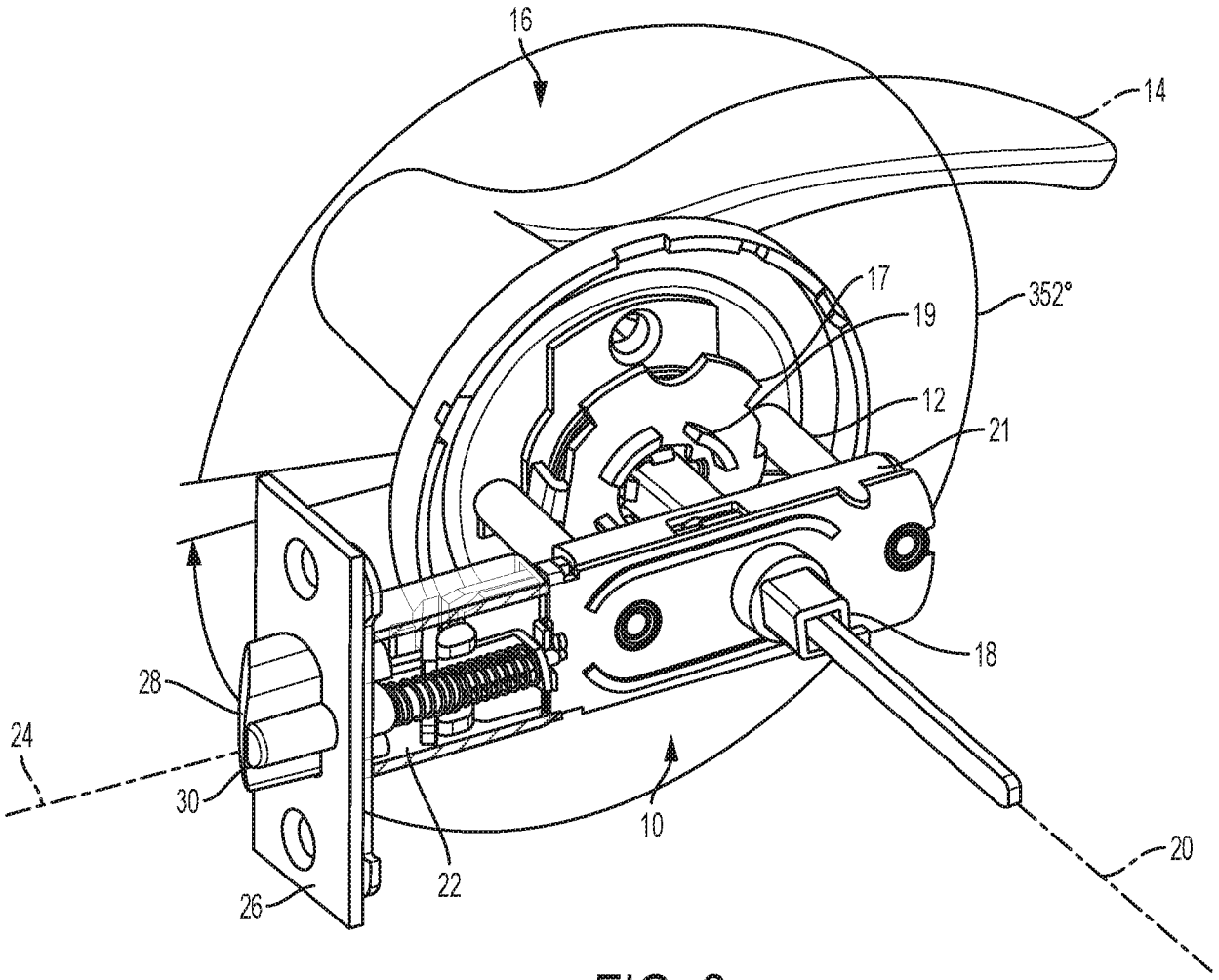
FIG. 2 is a view similar to that of FIG. 1, with the lever having moved an angular distance of 8 degrees.
Figure 3:
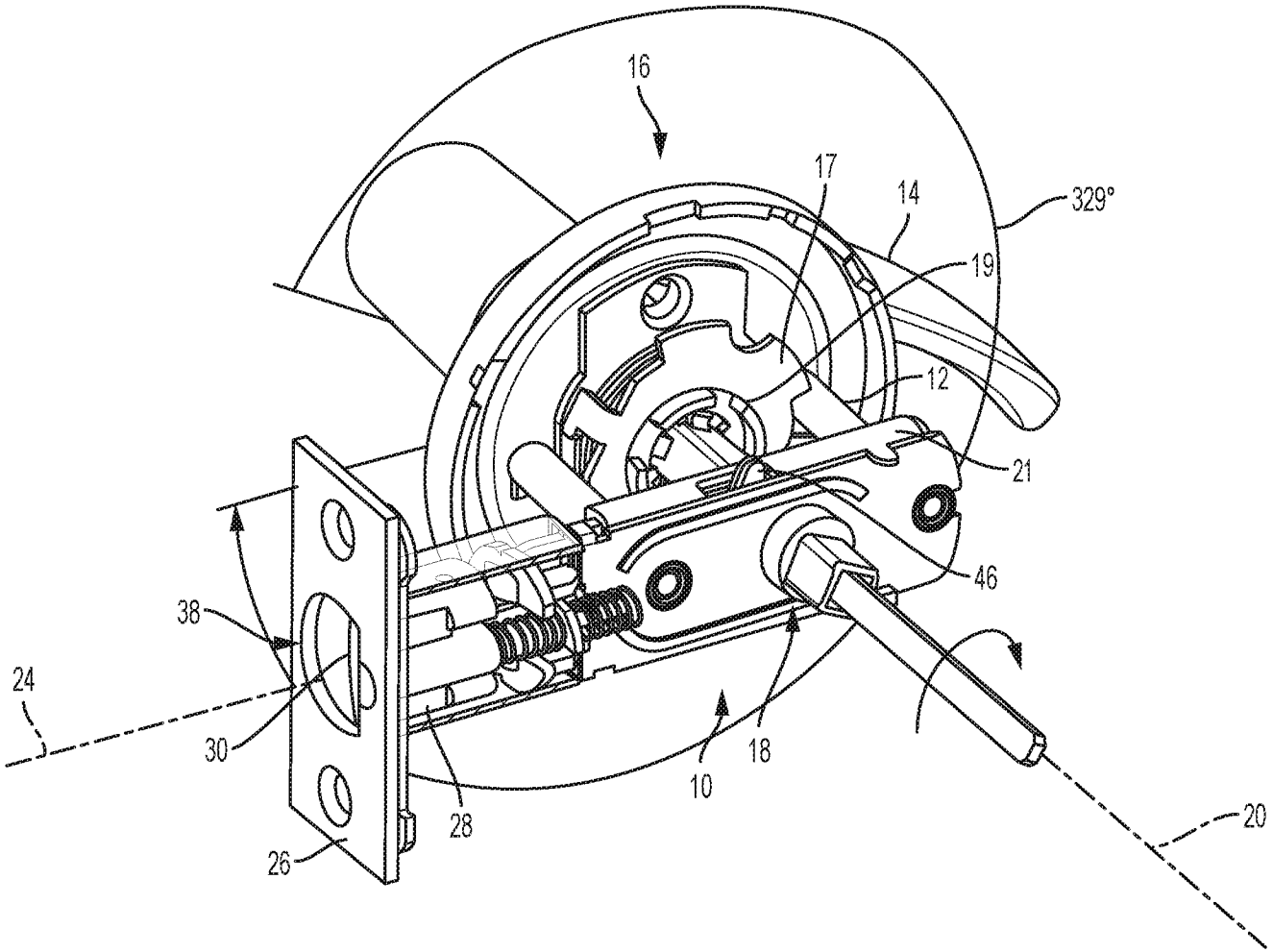
FIG. 3 is a view similar to that of FIG. 2, with the lever having moved 31 degrees, and illustrating how the lever stops rotating before a cam engages a bottom plate of the latch of FIG. 1.
Figure 4:
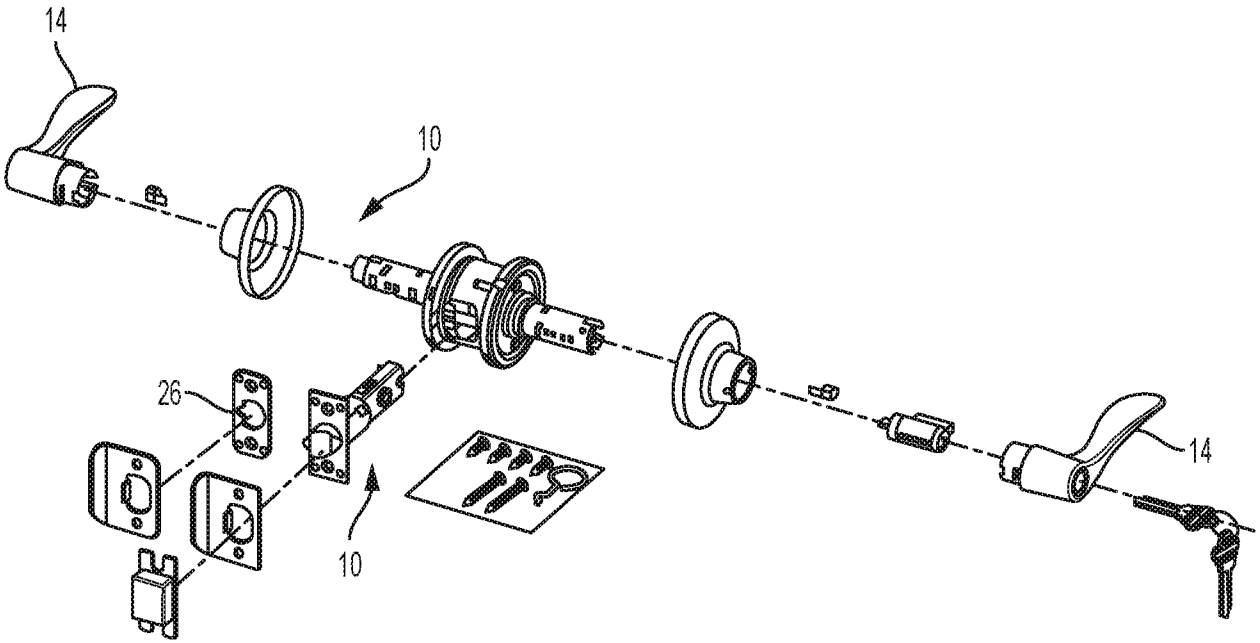
FIG. 4 is an exploded perspective detail view of a lock assembly including the latch system of FIG. 1.
Figure 5:
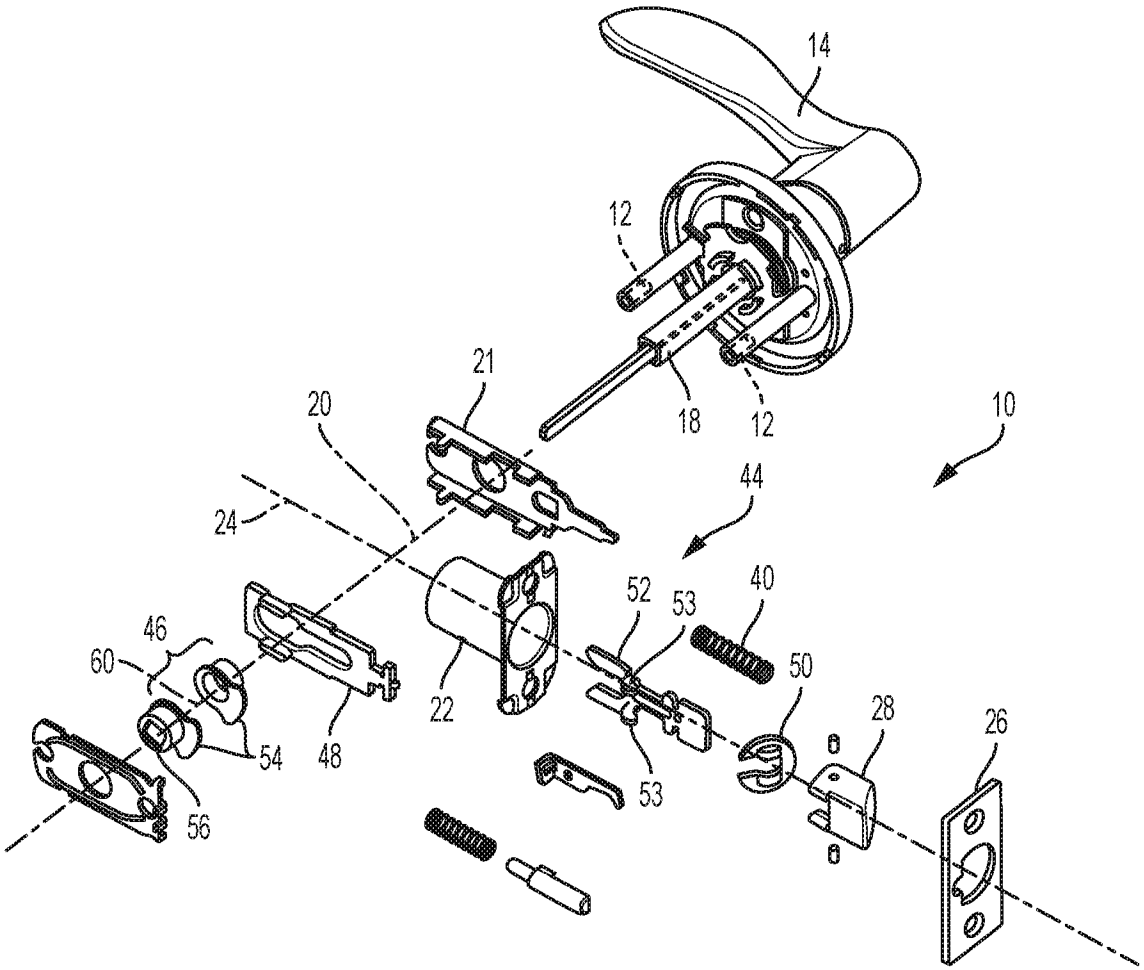
FIG. 5 is an exploded perspective detail view of the latch system of FIG. 1, juxtaposed with a lever subassembly.
Figure 6:
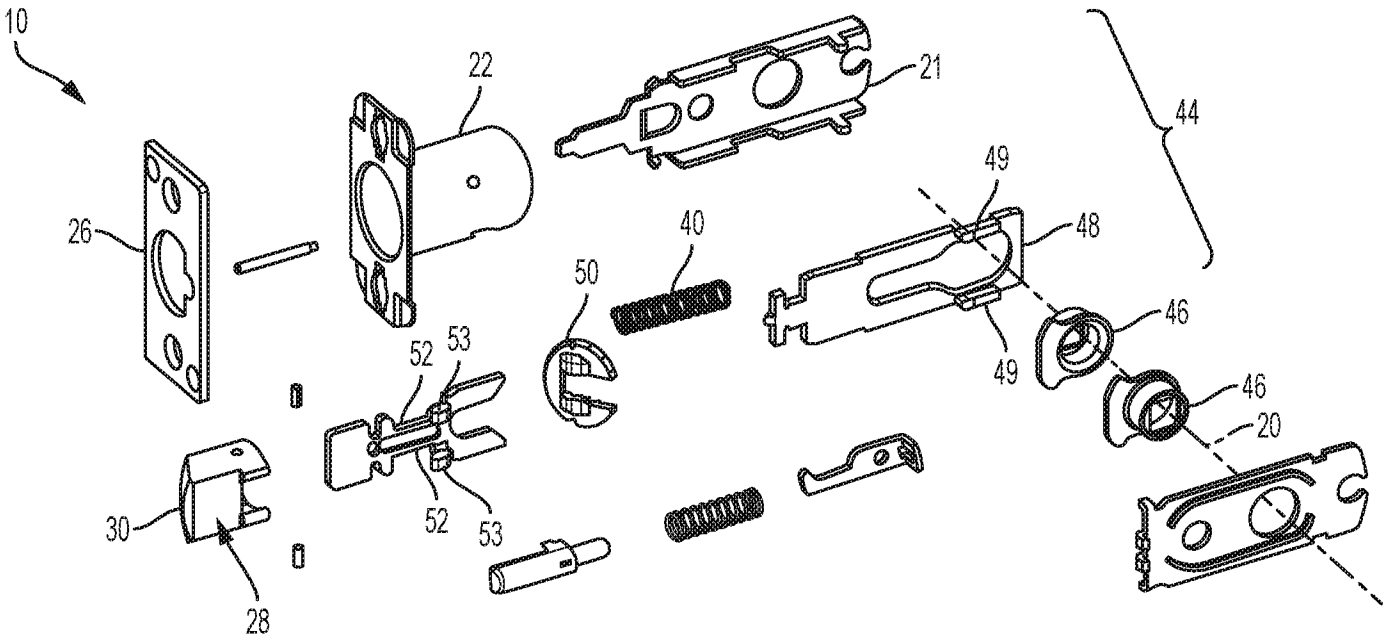
FIG. 6 is an exploded perspective detail view of the latch system of FIG. 1.
Figure 7:
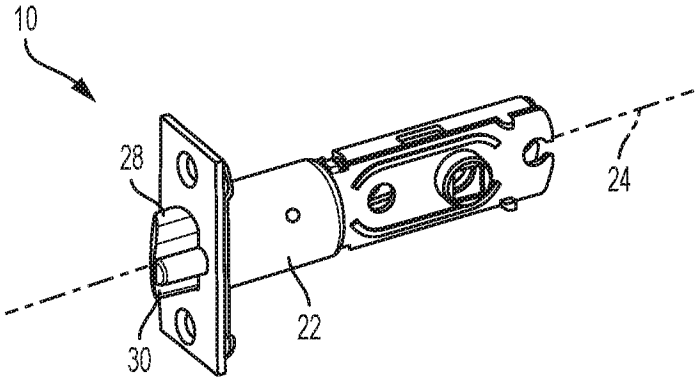
FIG. 7 is an assembled perspective view of the latch system of FIG. 1.
Figure 8:
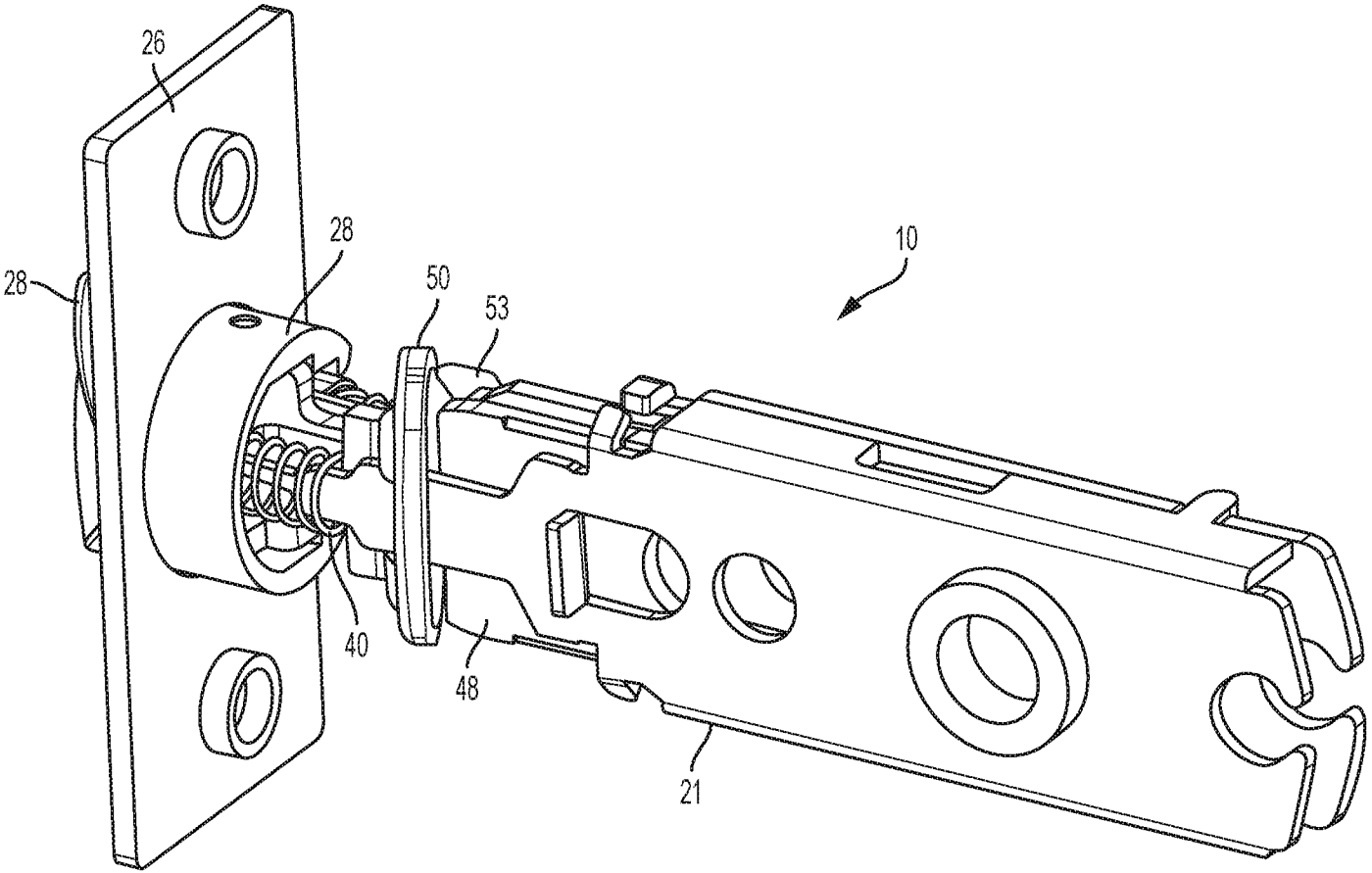
FIG. 8 is an enlarged perspective detail view of the latch system of FIG. 1, illustrating the positions of the latch spring on the latch case, and further illustrating the inter-engagement of the latch spring with the latch member, as well as the latch member with the drive member.
Figure 9:
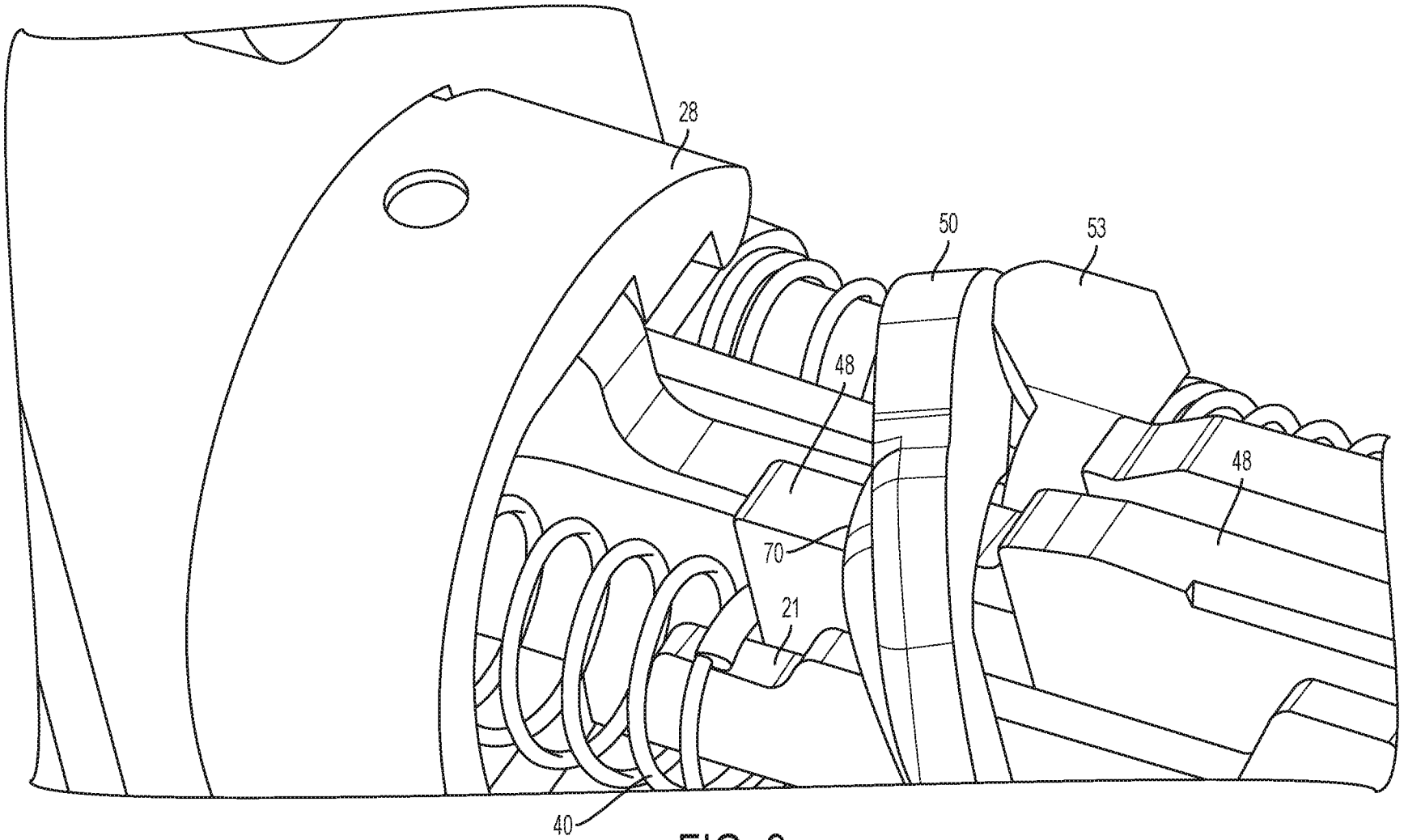
FIG. 9 is an enlarged perspective detail view of the latch system of FIG. 8, further showing the inter-engagement of the drive member with the latch bolt extension arms.
Figure 10:
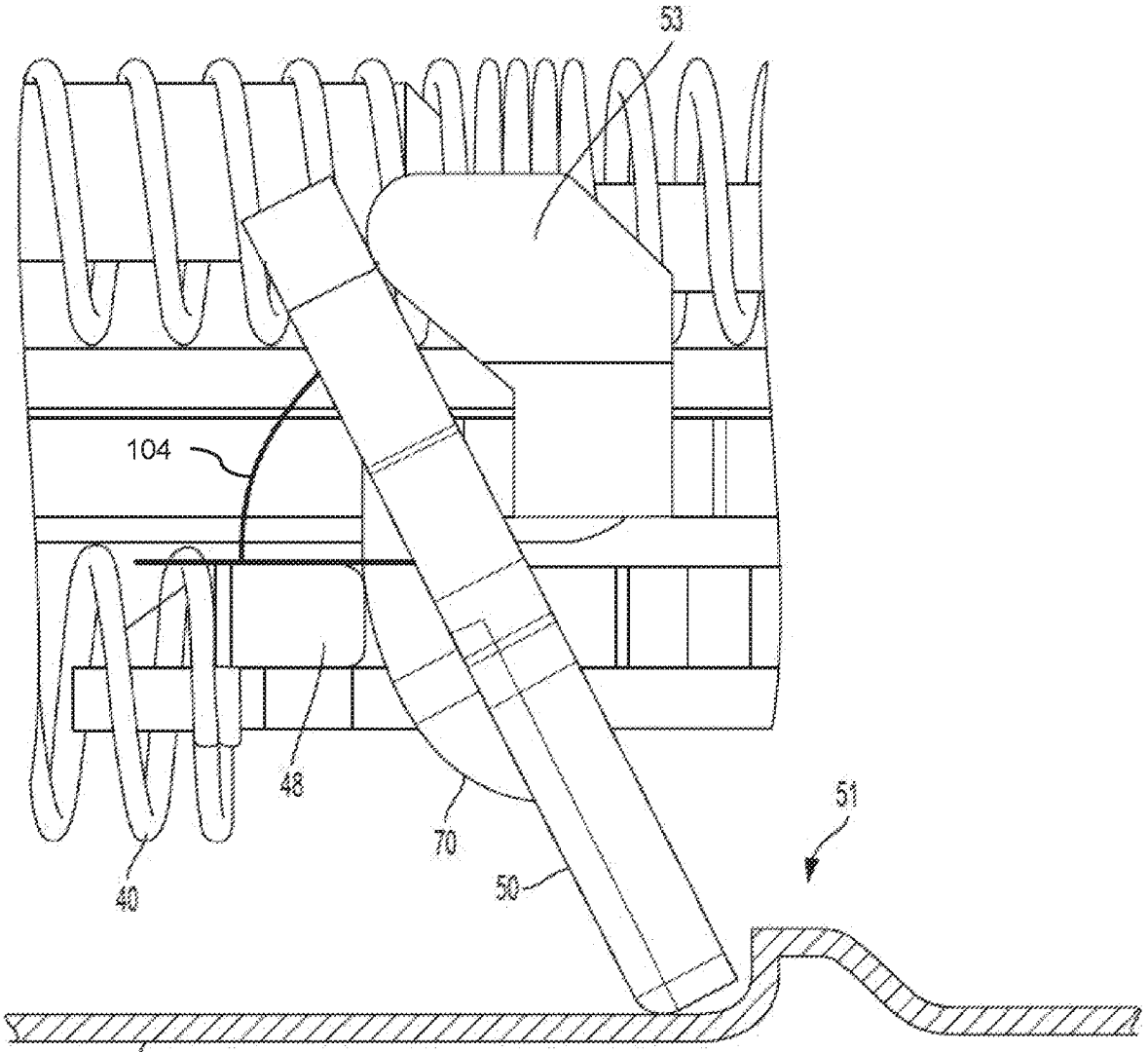
FIG. 10 is an enlarged, partially cut-away elevational detail view (with the latch system of FIG. 1 axially rotated 90 degrees) showing the drive member of FIG. 9 being engaged by the latch member, the drive member in turn engages the bolt extension arms of the latch system of FIG. 1.

With reference now to the drawings, in particular to FIGS. 1-18B thereof, apparatuses, systems, and methods embodying features, principles, and concepts of various exemplary embodiments of a small-angle latch system for a lock will be described. Referring now to FIGS. 1-4, an exemplary latch system 10 is connected by elongated tubular nuts 12 to an input member 14, illustratively a lever, of a lock assembly 16, such as a door lock. Other exemplary input members include knobs or other shapes having an exterior which may be grasped by an operator to rotate the input member.

The latch system 10 is actuated by a square rod or square tube 18 extending from the lock assembly 16 through the latch system 10. Rotating the input member 14 about an axis of rotation 20 causes the square tube to rotate components of the latch system 10 to retract a latch bolt 28 so that it is substantially flush with a faceplate 26. As is particularly shown in FIG. 3, rotation of the lever 14 past a certain point is prevented by a first component of the lock assembly 16, illustratively an axially-extending portion 17 of a rotating plate 19, contacting a second component of the lock assembly 16, illustratively one of the elongated tubular nuts 12. This prevents a portion of cam 46 (see FIG. 3) from striking or "bottoming-out" against the bottom plate or latch case 21 of the latch system 10.

Referring now to FIGS. 4-18B and particularly to FIGS. 5, 6, and 11A-11C, the small-angle latch system 10 includes a latch bolt housing 22 defining an axis of reciprocation 24, a faceplate 26, and a latch bolt 28 having a latch bolt tip 30. The latch bolt 28 is slidably disposed in the latch bolt housing 22 for reciprocating movement along the axis of reciprocation 24. The latch bolt 28 is biased to an extended position 36 by a latch spring 40. The latch case 21 is connected to the latch bolt housing 22 and supports a latch drive system 44, which couples the lever 14 with the latch bolt 28 to retract and extend the latch bolt. The latch drive system 44 includes a cam member 46 connected for rotation with the lever 14, a latch member 48 having at least one latch member protuberance 49 and engaged with the cam member 46, and a drive member 50 that pivots on the latch member 48. In the embodiment shown, the cam member 46 is made of two matching parts. However, in additional embodiments, the cam member 46 may be formed as a single piece.

Also, in the embodiment shown, the latch member 48 has two protuberances 49, so that the cam member 46 may engage the latch member whether the handle 14 is rotated clockwise or counterclockwise. In other embodiments, the latch member 48 may have a single protuberance 49. The latch drive system 44 also includes a latch plate or bolt extension 52 defining two bolt extension arms 53. The latch bolt extension 52 is connected to the latch bolt 28, such that rotation of the cam member 46 against the latch member protuberance 49 causes the latch member 48 to pivot the drive member 50 against the latch bolt extension 52 via the bolt extension arms 53 to retract the latch bolt 28 (see FIGS. 8-11C). The drive member 50 pivots about an interior protuberance 51 (see FIG. 10) formed on an inside surface of the latch bolt housing 22.

Figure 11A:
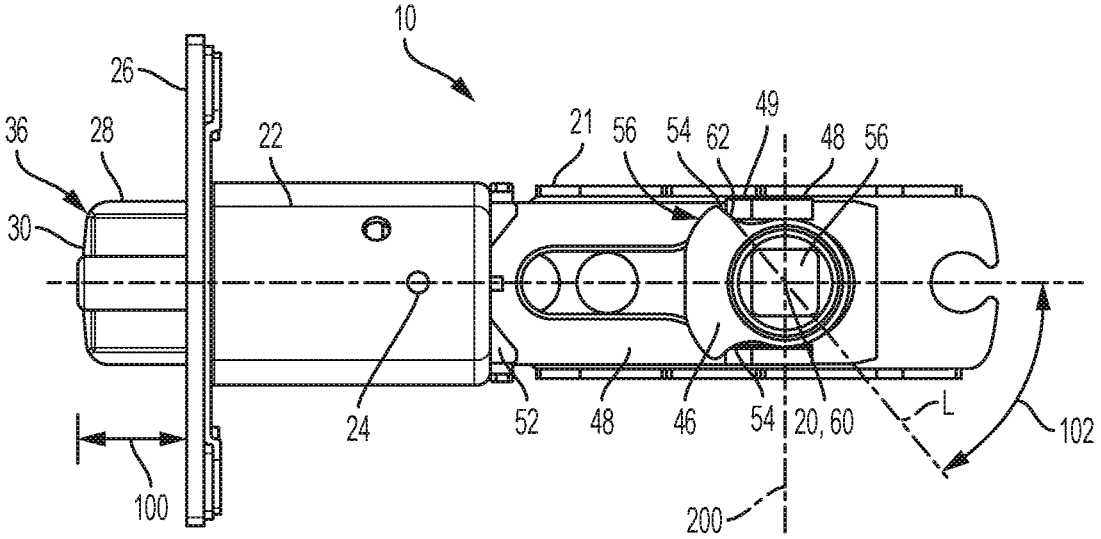
FIG. 11A is a left side elevational detail view of the latch system of FIG. 1 at rest in the rest configuration with the latch bolt fully extended.
Figure 11B:
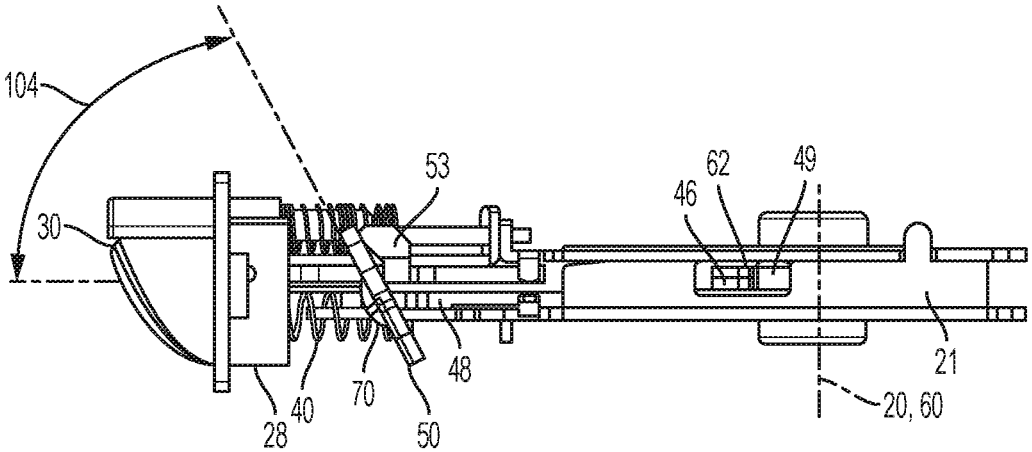
FIG. 11B is a top plan view of the latch system of FIG. 11A, the latch system having been axially rotated 90 degrees from the position shown in FIG. 11A.
Figure 11C:
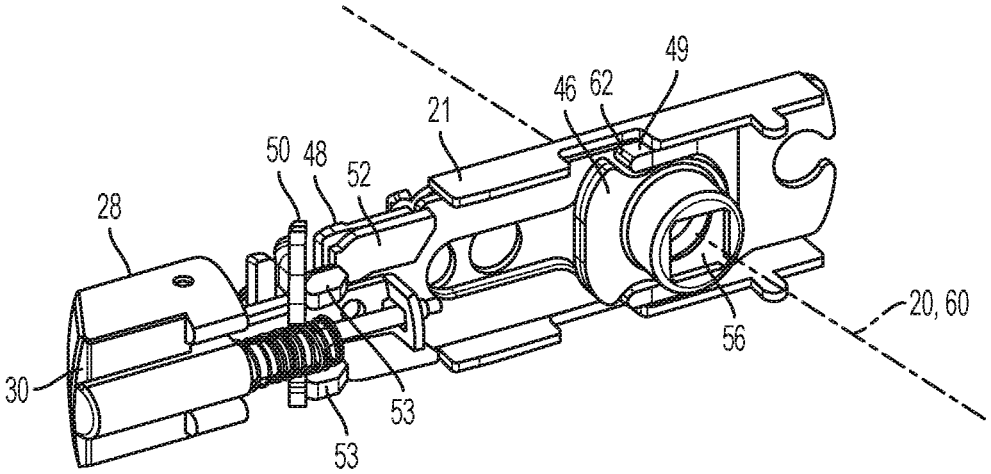
FIG. 11C is a left side perspective view of the latch system of FIG. 11A.

The cam member 46 is directly connected to the square tube 18, such that rotation of the lever 14 rotates the square tube, which in turn rotates the cam member 46. As shown in FIGS. 11A-11C, and particularly in FIGS. 11A and 17, the cam member 46 has a perimeter 56 including a concave cam surface 54 drivingly engaged with the latch member protuberance 49. The cooperation of the above-noted elements of this embodiment will retract the latch bolt 28 to the retracted position 38 with a rotation of the lever 14 through an angle in the range of from about 25 degrees through about 35 degrees, depending upon whether the latch is a passage-type system or an entrance-type system, without the system torque exceeding 28 inch-pounds. In another embodiment, the lever rotation in a passage-type system may be as low as 25 degrees-26 degrees, and in an entrance-type system, as low as 32 degrees-33 degrees, to retract the latch bolt 28.

Figure 17:
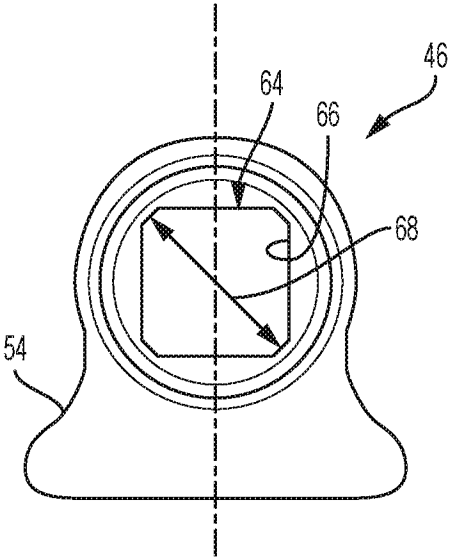
FIG. 17 is a front view of an exemplary cam of the latch system of FIG. 1.

Referring to FIG. 17, concave cam member 46 includes a cam aperture 64 which receives tube 18 (see FIG. 1). Cam aperture 64 is bounded by a perimeter wall 66 having a cam rotation radius which is one-half of the largest diameter of the cam aperture 64, indicated by diameter 68 in FIG. 17. The concave cam surface 54 of cam 46 may be circular and define a constant cam radius, such that the ratio of the cam radius to the cam rotation radius may be greater than or equal to 85%. In another embodiment, the ratio may be greater than or equal to 90%. In still another embodiment, the ratio may be substantially equal to 100%. In one example, the radius of concave cam surface 54 is 5.0 millimeters. Furthermore, in yet another embodiment, the concave cam surface may be defined by a variable radius.

In yet another embodiment, the concave cam member 46 may define a cam member center of rotation 60 coincident with the axis of rotation 20 of the lever 14.

Figure 18B:
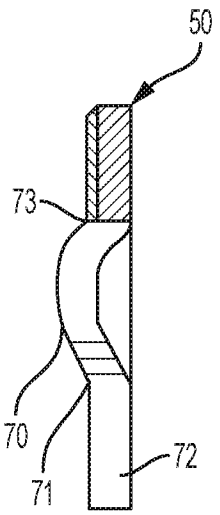
FIGS. 18A and 18B are a front view and a sectional view of an exemplary drive member of the latch system of FIG. 1.
Figure 18A:
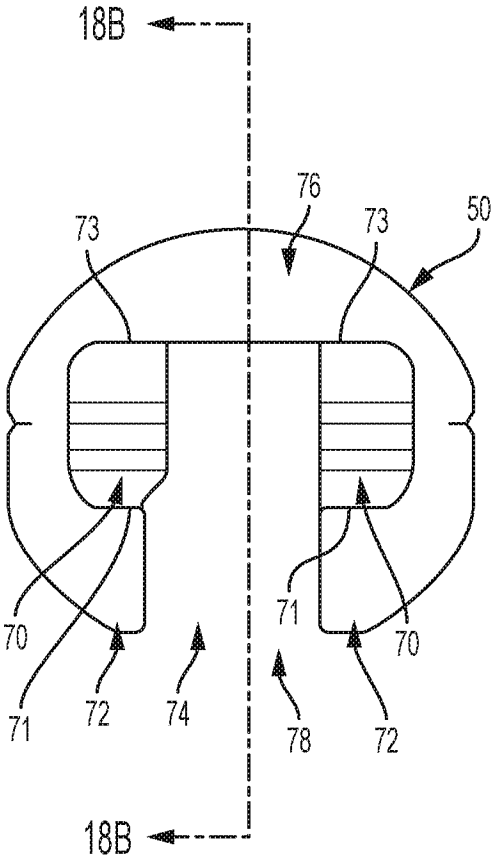

As shown in FIGS. 18A and 18B, the drive member 50 of latch system 10 may have a generally "U"-shaped configuration and define an open end and a closed end. The open end of the "U" includes two legs, on each of which is disposed a convex bulge 70 having a first end 71 and a second end 73. The convex bulges 70 are substantially parallel and include respective collinear lower edges at second end 73. The drive member may further include a central aperture 74 having a closed end 76 and an open end 78. Closed end 76, in one example, is collinear with the lower edges 73 of the convex bulges 70 and in another example, is offset from the lower edges 73 of the convex bulges. The convex bulges 70 engage latch member 48 and drive member 50 further engages bolt extension arms 53. The dimensions and orientation of the convex bulges 70, and the positions of the bulges 70 relative to the closed end 76 of the aperture 74 and to the bolt extension arms 53, are configured to cooperate with the concave cam member 46 of the latch system 10 to fully retract the latch bolt 28 when the cam member rotates 21 degrees or less, and even as little as 18 degrees, responsive to rotation of the lever 14. In one example, a length of each convex bulge 70 from the first end 71 to the second end 73 is at least 40% of an overall length of the drive member 50 from a tip of the first leg of the generally U-shaped body of the drive member 50 to a lower extreme of a connecting base of the generally U-shaped base connecting the two legs, the lower extreme of the connecting base being opposite the channel. In a further example, a ratio of (a) the difference of one half of the diameter of the drive member 50 minus a length of the connecting base of the drive member 50 along the centerline plane of the drive member over (b) one half of the diameter of the drive member is at least 40%.

Figure 12A:
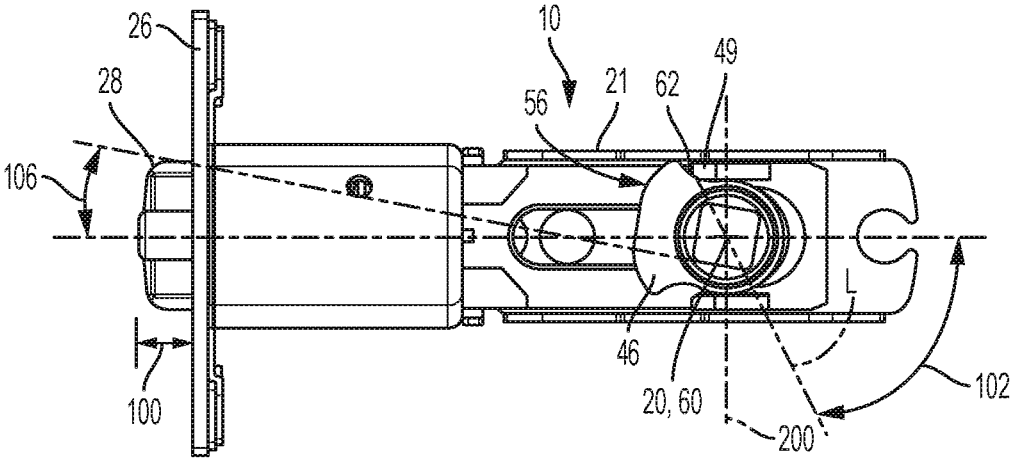
FIGS. 12A-12C are similar to FIGS. 11A-11C, respectively, but illustrating the latch system of FIG. 1 with the concave cam member having been rotated about half way through its total rotation angle of 18 degrees due to a rotation of the input member of the lock assembly.
Figure 12B:
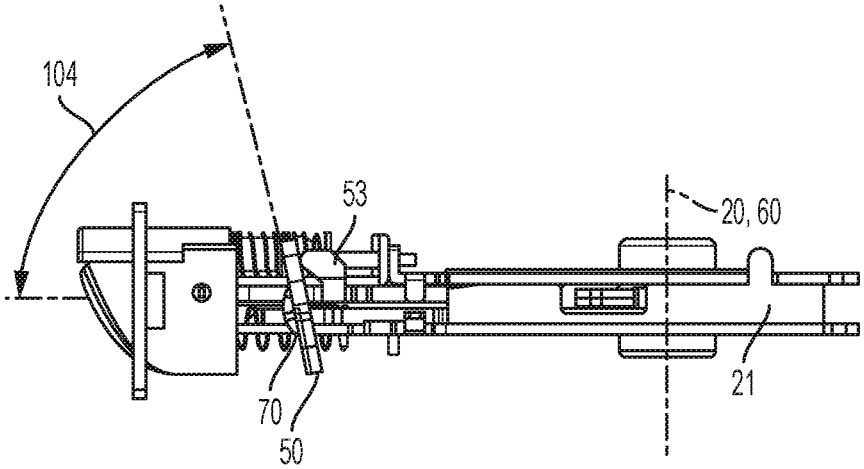
Figure 12C:
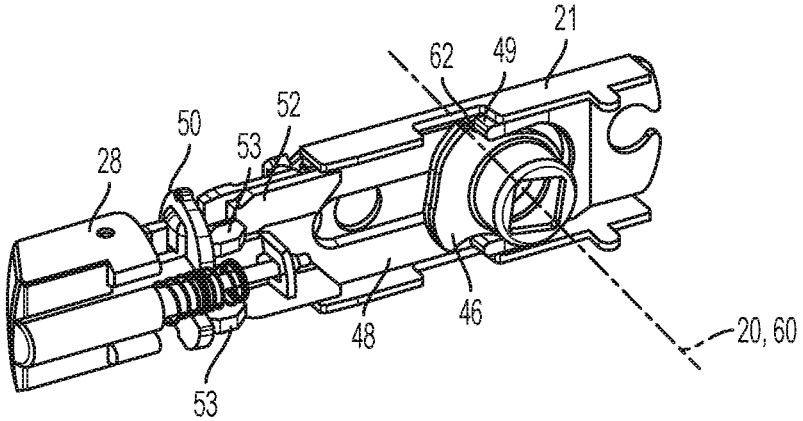
Figure 13A:
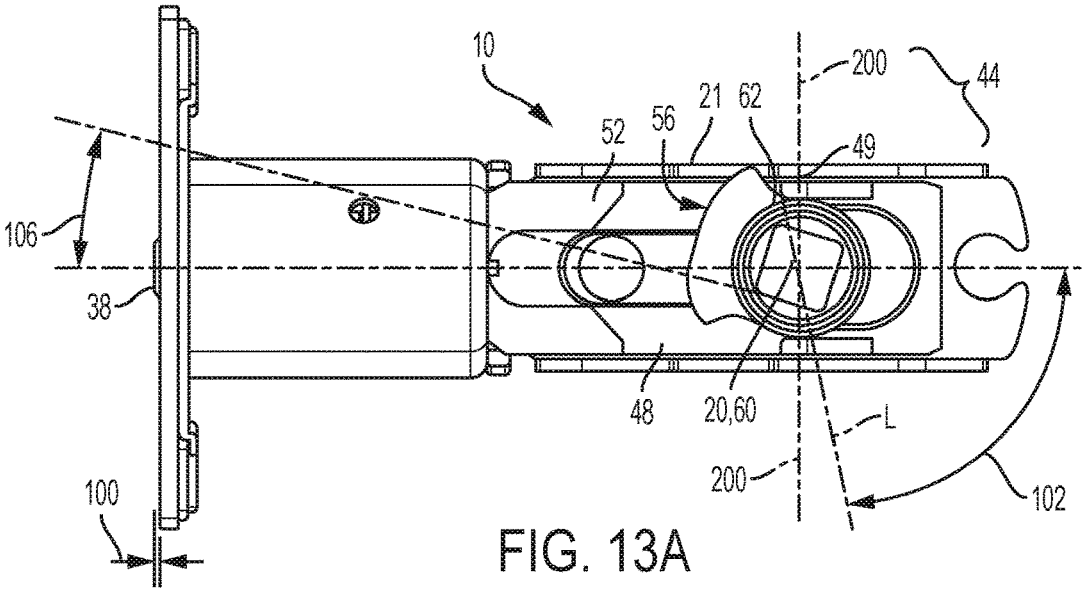
FIGS. 13A-13C are similar to FIGS. 11A-11C, respectively, but illustrating the latch system of FIG. 1 in the actuated configuration with the latch bolt fully retracted and the tip of the latch bolt being substantially flush with an outer surface of the faceplate.
Figure 13B:
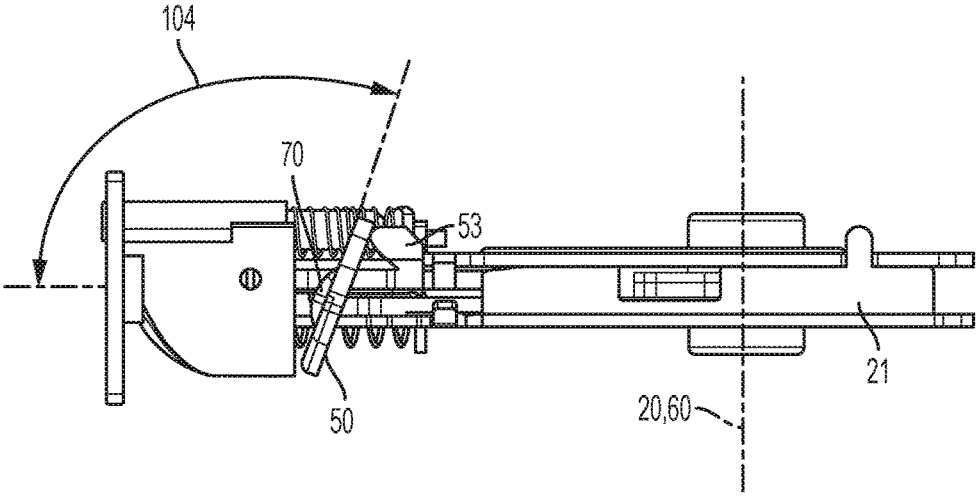
Figure 13C:
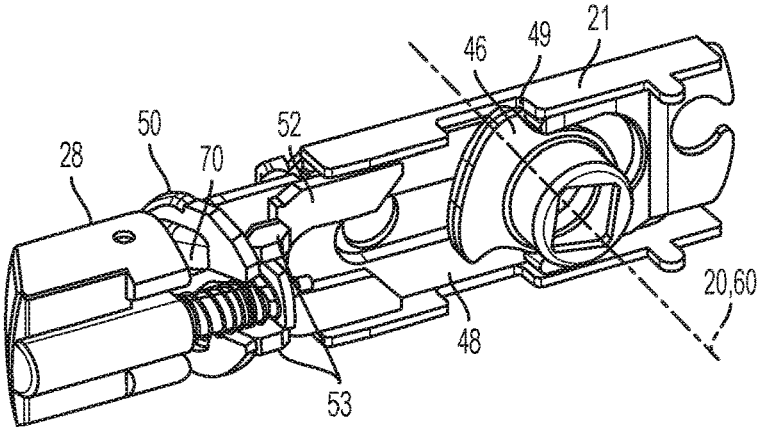

As shown in FIGS. 11A, 12A and 13A, a line L drawn through the center of rotation 20 to a point of contact 62 with the protuberance 49, stays to a first side of vertical plane passing through a line 200 which passes through the axis of rotation 20 as the latch bolt 28 is retracted, so that the contact point 62 remains between the vertical plane defined by line 200 and faceplate 26. However, in other embodiments, it may be desirable not to require that all points of contact 62 occur to the left of vertical line 200, depending upon the configurations and dimensions of for example, the cam member 46 and latch member 48.

Figure 14:
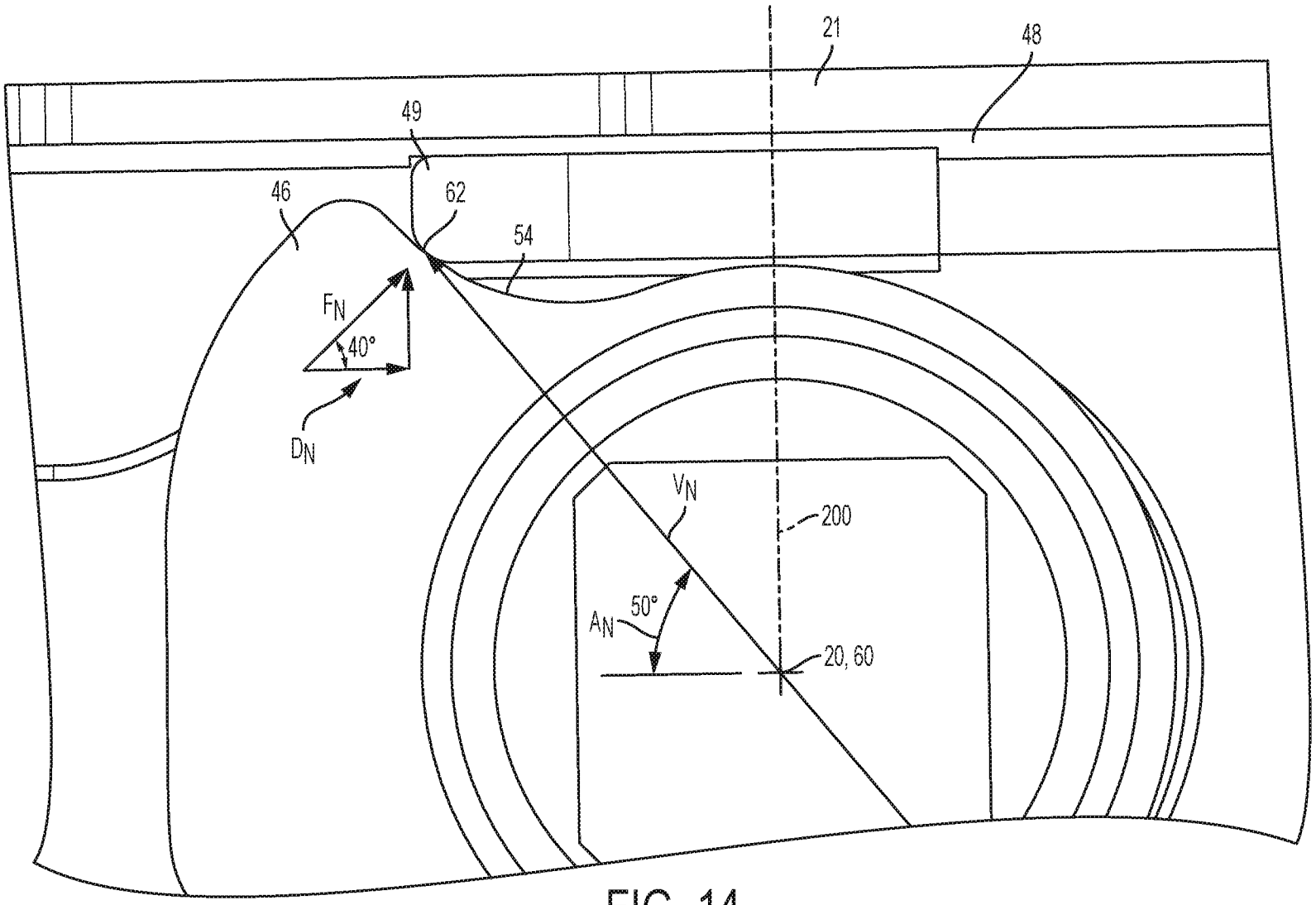
FIGS. 14, 15 and 16 are enlarged side elevational detail views of the latch system shown in FIGS. 11A, 12A, and 13A, respectively, and illustrate schematically the interaction of the concave cam member of the latch system of FIG. 1 with a protuberance of the latch member of the latch system of FIG. 1, and showing the resultant relatively low mechanical advantage generated by the small-angle latch system of FIG. 1.
Figure 15:
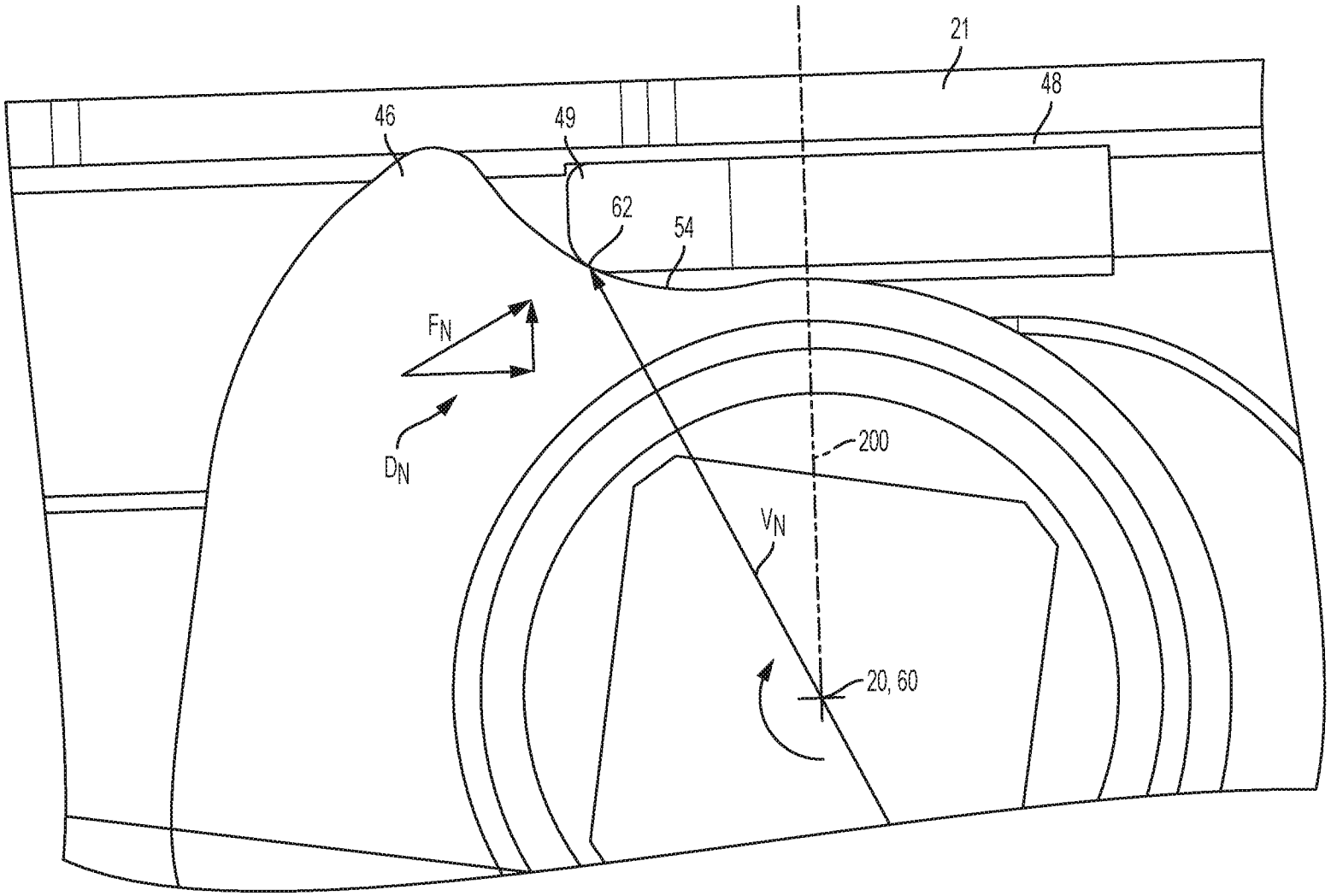
Figure 16:
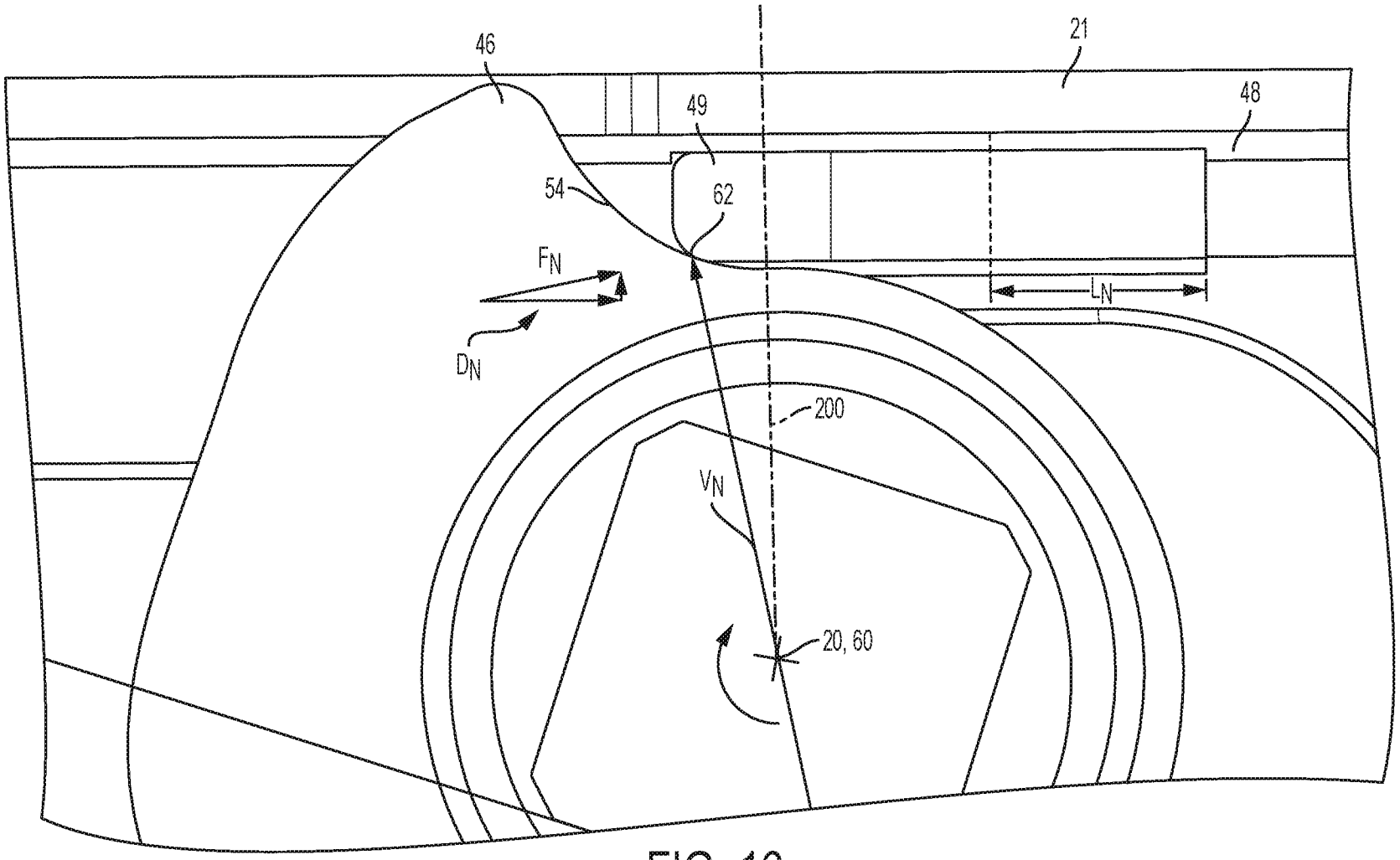

Referring to FIGS. 14-16, for purposes of illustration, a line drawn from the axis of rotation 20 of the lever 14 (which access is coincident with the axis or center of rotation 60 of convex cam member 46), to a point of contact 62 of the convex cam member with a protuberance 49 of the latch member 48, is representative of the direction of the force exerted by the lever 14 in rotating the cam member 46 against the latch member 48. This line is designated "drive vector Vn." FIG. 14 corresponds to the rest configuration of latch system 10 and FIG. 11A. FIGS. 15 and 16 correspond to FIGS. 12A and 13A, respectively. As shown in FIG. 14, cam 46 contacts protuberance 49 when latch system 10 is in the rest configuration and throughout movement to the actuated configuration shown in FIG. 16.

As schematically shown in the force diagrams, Dn, in FIGS. 14-16, as the point of contact 62 of cam surface 54 progressively begins to slide "down" 'the concave cam curve, the horizontal component of the force Fn is relatively small, compared conventional latch systems resulting in the torque required to rotate a lever 14 being larger in latch system 10 relative to conventional latch systems. However, as a result of the configuration of latch system 10, the torque upon the lever 14 remains below a limit of 28 inch-pounds. As the lever 14 rotates, the horizontal component of the force Fn increases, but still remains relatively small compared to that generated by a conventional latch system.

As shown, for example, in FIG. 14, the initial angle An of the drive vector Vn relative to the horizontal of the latch system 10 of the present invention, has been selected to be about 50 degrees. However, in other embodiments, the initial angle An may be selected to be any angle equal to or greater than 45 degrees, depending upon the dimensions and configurations of such system elements as cam 46 and latch member 48.

Referring to FIG. 11A, in the rest configuration, latch bolt 28 is fully extended by a distance 100 from an outer surface of faceplate 26. In one example, distance 100 is 12 millimeters. The line, L, makes an angle 102 having a value of 50 degrees relative to horizontal and the drive member 50 makes an angle 104 having a value of 61 degrees relative to horizontal. Referring to FIG. 12A, cam 46 is rotated an angle 106 having a value of 9 degrees which results in angle 102 having an increasing value to 63 degrees, angle 104 having an increasing value to 78 degrees, and distance 100 having a decreasing value to 7.3 millimeters. Referring to FIG. 13A, cam 46 is rotated an angle 106 having a value of 18 degrees to the actuated configuration wherein the latch bolt 28 is fully retracted which results in angle 102 having an increasing value to 78 degrees, angle 104 having an increasing value to 110 degrees, and distance 100 having a decreasing value to 0.6 millimeters.

It has been discovered that if the initial point of contact of a cam with the latch member were configured to occur as far to one side (such as the left) as possible of the center of rotation of the lever/cam, then a smaller amount of lever rotational angle would horizontally translate the latch member through approximately the same distance as is traveled by the latch member of a conventional system, resulting in full retraction of the latch bolt.

It has further been discovered that by using a cam member with a concave cam surface to engage the latch member initially at a relatively shallow angle (producing a relatively low mechanical advantage, and thus requiring a relatively high initial torque to be placed on the lever), a significantly higher amount of latch bolt retraction could be achieved per unit of lever or knob rotation. Therefore, in an entrance-type lock, for example, a lever rotation as small as 32 degrees could be obtained without exceeding 28 inch-pounds of torque on the lever. This represents almost a 40% reduction in lever rotation from a conventional system. In a passage-type lock, the lever rotation angle can be reduced to as little as 25 degrees.

Accordingly, in one embodiment, a latch system is drivingly connected to a lever or knob of a lock assembly, where the lever or knob defines an axis of rotation. The latch system further includes a latch bolt housing defining an axis of reciprocation, and a faceplate attached to the latch bolt housing. A latch bolt having a latch bolt tip is slidably disposed in the latch bolt housing for reciprocating movement along the axis of reciprocation between an extended position and a retracted position, the retracted position defined by the latch bolt tip being substantially flush with the faceplate. The latch bolt is biased to the extended position by a latch spring. The small-angle latch system further includes a latch case connected to the latch bolt housing, and a latch drive system disposed on the latch case and operatively associated with the lock lever or knob. The latch drive system couples the lever or knob with the latch bolt to retract and extend the latch bolt. The latch drive system produces a system torque, which is measured at the lever when rotation of the lever retracts the latch bolt to the retracted position. The latch drive system further includes a cam member connected for rotation with the lever, a latch member engaged with the cam member, a drive member disposed for pivoting movement on the latch member, and a bolt extension connected to the latch bolt and operatively associated with the drive member, such that rotation of the earn member causes the latch member to pivot the drive member against the bolt extension to retract the latch bolt. The cam member includes a concave cam surface drivingly engaged with the latch member. The cooperation of the above-noted elements of this embodiment of the present invention will retract the latch bolt to the retracted position with a rotation of the lever through an angle in the range of from only about 25 degrees through about 35 degrees, depending upon whether the latch is a passage-type system or an entrance-type system, without the system torque upon the lever exceeding 28 inch-pounds.

In another embodiment, the cam member may include a cam aperture having a cam rotation radius, and is operatively associated with the lever. The concave cam surface may be circular and define a constant cam radius, such that the ratio of the earn radius to the cam rotation radius is greater than or equal to 85%. In still another embodiment, the ratio may be greater than or equal to 90%. In yet another embodiment, the ratio may be substantially equal to 100%. In a further embodiment, the cam surface may be defined by a variable radius.

In yet another embodiment, the lever may retract the latch bolt to its retracted position when the concave cam member rotates 21 degrees or less responsive to rotation of the lever, still without the system torque exceeding 28 inch-pounds upon the lever. In still another embodiment, the lever may retract the latch bolt to its retracted position when the concave cam member rotates through a range of from about 18 degrees to about 21 degrees. In yet another embodiment, the cam surface immediately begins moving the latch member when the lever starts to turn, so that there is no lost motion.

In another embodiment, the concave cam member may define a cam member center of rotation coincident with the center of rotation of the lever. The concave cam surface engages the latch member at a point of contact, such as a latch member protuberance. The initial point of contact occurs when the latch bolt is fully extended, and is configured so that a drive vector extending from the center of rotation of the concave cam member to the initial point of contact, may be disposed at an angle in the range of from about 45 degrees to about 50 degrees to the horizontal (a line parallel to the axis of reciprocation of the latch member) ("drive vector angle"). In yet another embodiment, when the lever retracts the latch bolt to its retracted position, the drive vector angle may rotate through a total angle of about 78 degrees. In a further embodiment, during the operation of the small-angle latch system of the present invention, the drive vector angle may remain an acute angle. In yet another embodiment, the points of contact of the concave cam surface with the latch member will remain to the left of a vertical line drawn through the center of the axis of rotation of the cam member.

In still another embodiment, the drive member may have a generally "U"-shaped configuration and define an open end and a closed end. The closed end of the "U" bears against a protuberance formed on an interior surface of the latch bolt housing as the drive member pivots on the latch member. The open end of the "U" includes two legs, on each of which is disposed a convex bulge. The convex bulges are substantially parallel and include respective collinear lower edges. The drive member may further include a central aperture having a closed end and an open end. The convex bulges engage respective arms formed on the bolt extension. The dimensions and orientation of the convex bulges, and the positions of the bulges relative to the closed end of the aperture and to the bolt extension arms, may be configured to cooperate with the concave cam member to fully retract the latch bolt when the cam member rotates through an angle in the range of from about 18 degrees to about 21 degrees, responsive to rotation of the lever.

In yet another embodiment, a method of retracting a latch bolt for a lock assembly having a lever operatively associated with the cam member, where the axis of rotation of the lever and cam member are coincident, may include disposing a latch member relative to the center of rotation of the lever and cam member, so that during the operation of the lock assembly, the point of contact of the cam member with the latch member remains on one side of a vertical line drawn from the latch member through the axis of rotation.

In a further embodiment, a method of minimizing the amount of rotation required for a lever of a lock assembly to retract the lock assembly latch bolt, while utilizing the same physical envelope of a conventional latch system, may include disposing a cam member having a concave cam surface, and a latch member operatively associated with the earn member, in the conventional latch system envelope so that the handle rotation lies in the range of from about 25 degrees through about 35 degrees, without exceeding a maximum torque upon the lever of 28 inch-pounds.

In yet another embodiment, a method for retracting a latch bolt to its retracted position in a small-angle tubular latch system of a lock assembly having a lever, where the lever defines an axis of rotation, where the lever is operatively associated with a latch member disposed for reciprocating movement along an axis of reciprocation, and where the latch member is operatively associated with the latch bolt, may include engaging a concave cam surface with the latch member so that rotation of the lever through an angle in the range of from about 32 degrees through about 35 degrees may retract the latch bolt to its retracted position. In still another embodiment, the method may include disposing the cam surface on a cam member having an axis of rotation coincident with the axis of rotation of the lever; engaging the cam surface with the latch member at an angle in the range of from about 45 degrees to about 50 degrees to the horizontal with a drive vector intersecting the center of rotation and the point of engagement of the cam surface with the latch member, thereby creating a drive vector angle: and rotating the lever so that the vector angle increases to about 78 degrees.

In yet another embodiment, the method may include rotating the cam member through a total angle in the range of from about 18 degrees to about 21 degrees, while maintaining the torque on the lever at or below 28 inch-pounds.

By this point, it can be seen that the latch system of the present invention, in contravention of conventional engineering best practices, has been able to significantly reduce the amount of lever rotation required to retract the latch bolt, without exceeding the maximum torque limit of 28 inch-pounds. It can also be seen that this new latch system can be readily emplaced in the physical envelope of the conventional lock and latch system with a minimum of modifications to the structure of the conventional lock and latch system.

While this invention has been described as having exemplary designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

We claim:

1. A latch system adapted to be drivingly connected to an input member of a lock assembly, the latch system comprising:

a latch bolt housing defining an axis of reciprocation;

a faceplate coupled to the latch bolt housing, the faceplate having a latch bolt opening which intersects the axis of reciprocation;

a latch bolt having a latch bolt tip, the latch bolt being moveably disposed in the latch bolt housing for reciprocating movement along the axis of reciprocation; and a latch drive system adapted to couple the input member of the lock assembly to the latch bolt to move the latch bolt along the axis of reciprocation, the latch drive system including:

a cam adapted to be connected for rotation with the input member, the cam rotating about an axis of rotation, the cam having an outer perimeter including a concave portion, a latch member disposed for reciprocating movement along the axis of reciprocation, the latch member including at least one protuberance positioned to be engaged with the cam, a drive member disposed in the latch bolt housing, the drive member having a convex portion arranged to be engaged by a portion of the latch member to pivot the drive member relative to the latch bolt housing against a protuberance formed on an interior surface of the latch bolt housing, the portion of the latch member being positioned between the drive member and the faceplate, and a latch bolt extension coupled to the latch bolt, the latch bolt extension having an arm positioned to be engaged by the drive member;

the latch system having a rest configuration wherein the latch bolt is positioned in a fully extended position with the latch bolt tip extending a first distance from an outer surface of the faceplate in a direction away from the axis of rotation and an actuated configuration wherein in response to a system torque on the input member of the lock assembly the latch bolt tip moves towards the axis of rotation to a retracted position substantially flush with the outer surface of the faceplate, the protuberance of the latch member contacting the concave portion of the outer perimeter of the cam as the latch bolt moves from the extended position to the retracted position, the latch drive system moves the latch bolt from the extended position to the retracted position when the cam is rotated about the axis of rotation through a first angle of up to about 21 degrees; and wherein the protuberance of the latch member contacts the outer perimeter of the cam when the latch system is in the rest configuration.

2. The latch system of claim 1, wherein the protuberance of the latch member contacts the outer perimeter of the cam throughout the rotation of the cam through the first angle.

3. The latch system of claim 1, wherein the cam includes a cam aperture having a cam aperture perimeter surrounding the axis of rotation, the cam aperture having a cam rotation radius, the concave portion of the outer perimeter of the cam having a constant cam radius, a ratio of the cam radius of the concave portion of the outer perimeter of the cam to the cam rotation radius is at least 85%.

4. The latch system of claim 3, wherein the ratio of the cam radius of the concave portion of the outer perimeter of the cam to the cam rotation radius is at least 90%.

5. The latch system of claim 3, wherein the ratio of the cam radius of the concave portion of the outer perimeter of the cam to the cam rotation radius is about 100%.

6. The latch system of claim 1, wherein the concave portion of the outer perimeter of the cam has a variable radius.

7. The latch system of claim 1, wherein the first angle is in a range of from about 18 degrees to about 21 degrees.

8. The latch system of claim 1, wherein the movement of the latch bolt from the extended position to the retracted position is in response to a rotation of the input member of the lock assembly through a second angle in a range of about 25 degrees to about 35 degrees.

9. The latch system of claim 8, wherein a system torque of up to 28 inch-pounds upon the input member of the lock system is applied to result in the rotation of the input member of the lock assembly through the second angle.

10. The latch system of claim 8, wherein the second angle is about 25 degrees.

11. The latch system of claim 8, wherein the second angle is about 32 degrees.

12. The latch system of claim 1, further comprising a latch case connected to the latch bolt housing, the latch drive system disposed on the latch case.

13. The latch system of claim 12, wherein the latch case includes an opening, the cam extending through the opening of the latch case when the latch system is in the actuated configuration.

14. The latch system of claim 13, wherein a first component of the lock assembly contacts a second component of the lock assembly to prevent the cam from contacting an edge of the opening in the latch case, the first component of the lock assembly being spaced apart from the second component of the lock assembly when the latch system is in the rest configuration.

15. The latch system of claim 1, wherein the input member rotates about the axis of rotation defined by the cam.

16. The latch system of claim 1, wherein the axis of reciprocation is substantially perpendicular to the axis of rotation.

17. The latch system of claim 1, wherein the drive member has a generally U-shaped body having a pair of legs and a connecting base connecting a first leg of the pair of legs to a second leg of the pair of legs, the generally U-shaped body including a channel positioned between the pair of legs and having an open end and a closed end opposite the open end.

18. The latch system of claim 17, wherein the connecting base of the generally U-shaped body bears against a protuberance formed on an interior surface of the latch bolt housing as the drive member pivots relative to the latch bolt housing.

19. The latch system of claim 18, wherein the convex portion of the drive member includes a first convex bulge disposed on the first leg of the pair of legs and a second convex bulge disposed on the second leg of the pair of legs.

20. The latch system of claim 19, wherein each of the first convex bulge and the second convex bulge includes a first end and a second end positioned between the first end and the connecting base of the generally U-shaped body.

21. The latch system of claim 20, wherein the second end of the first convex bulge is collinear with the second end of the second convex bulge.

22. The latch system of claim 20, wherein a length of the first convex bulge from the first end of the first convex bulge to the second end of the first convex bulge is at least 40% of an overall length of the drive member from a tip of the first leg of the generally U-shaped body of the drive member to a lower extreme of the connecting base of the generally U-shaped base, the lower extreme of the connecting base being opposite the channel.

23. The latch system of claim 22, wherein the second convex bulge is identical to the first convex bulge.

24. The latch system of claim 1, wherein the protuberance of the latch member engages the concave portion of the outer perimeter of the cam member prior to the latch bolt moving from the extended position to the retracted position.

25. The latch system of claim 1, wherein the protuberance of the latch member contacts the concave portion of the outer perimeter of the cam member when the latch system is in the rest configuration.

26. A latch system adapted to be drivingly connected to an input member of a lock assembly, the latch system comprising:

a latch bolt housing defining an axis of reciprocation;

a faceplate coupled to the latch bolt housing, the faceplate having a latch bolt opening which intersects the axis of reciprocation;

a latch bolt having a latch bolt tip, the latch bolt being moveably disposed in the latch bolt housing for reciprocating movement along the axis of reciprocation; and a latch drive system adapted to couple the input member of the lock assembly to the latch bolt to move the latch bolt along the axis of reciprocation, the latch drive system including:

a cam adapted to be connected for rotation with the input member, the cam rotating about an axis of rotation, the cam having an outer perimeter including a concave portion, a latch member disposed for reciprocating movement along the axis of reciprocation, the latch member including at least one protuberance positioned to be engaged with the cam, a drive member disposed in the latch bolt housing, the drive member having a convex portion arranged to be engaged by a portion of the latch member to pivot the drive member relative to the latch bolt housing against a protuberance formed on an interior surface of the latch bolt housing, the portion of the latch member being positioned between the drive member and the faceplate, and a latch bolt extension coupled to the latch bolt, the latch bolt extension having an arm positioned to be engaged by the drive member;

the latch system having a rest configuration wherein the latch bolt is positioned in a fully extended position with the latch bolt tip extending a first distance from an outer surface of the faceplate in a direction away from the axis of rotation and an actuated configuration wherein in response to a system torque on the input member of the lock assembly the latch bolt tip moves towards the axis of rotation to a retracted position substantially flush with the outer surface of the faceplate, the protuberance of the latch member contacting the concave portion of the outer perimeter of the cam as the latch bolt moves from the extended position to the retracted position, the latch drive system moves the latch bolt from the extended position to the retracted position when the cam is rotated about the axis of rotation through a first angle of up to about 21 degrees, wherein the outer perimeter of the cam contacts the protuberance of the latch member when the latch system is in the rest configuration at an initial point of contact, a drive vector passing through the axis of rotation and the initial point of contact forms a drive vector angle relative to horizontal in the range of from about 45 degrees to about 50 degrees.

27. The latch system of claim 26, wherein as the latch system moves to the actuated configuration, the drive vector angle increases.

28. The latch system of claim 26, wherein as the latch system moves to the actuated configuration, the drive vector angle remains an acute angle.

29. The latch system of claim 26, wherein the concave portion of the outer perimeter of the cam remains on a first side of a vertical plane passing through the axis of rotation as the latch system moves from the rest configuration to the actuated configuration, the drive member being positioned on the first side of the vertical plane.

30. A latch system adapted to be drivingly connected to an input member of a lock assembly, the latch system comprising:

a latch bolt housing defining an axis of reciprocation;

a faceplate coupled to the latch bolt housing, the faceplate having a latch bolt opening which intersects the axis of reciprocation;

a latch bolt having a latch bolt tip, the latch bolt being moveably disposed in the latch bolt housing for reciprocating movement along the axis of reciprocation; and a latch drive system adapted to couple the input member of the lock assembly to the latch bolt to move the latch bolt along the axis of reciprocation, the latch drive system including:

a cam adapted to be connected for rotation with the input member, the cam rotating about an axis of rotation, the cam having an outer perimeter including a concave portion, a latch member disposed for reciprocating movement along the axis of reciprocation, the latch member including at least one protuberance positioned to be engaged with the cam, a drive member disposed in the latch bolt housing, the drive member having a convex portion arranged to be engaged by a portion of the latch member to pivot the drive member relative to the latch bolt housing against a protuberance formed on an interior surface of the latch bolt housing, the portion of the latch member being positioned between the drive member and the faceplate, and a latch bolt extension coupled to the latch bolt, the latch bolt extension having an arm positioned to be engaged by the drive member;

the latch system having a rest configuration wherein the latch bolt is positioned in a fully extended position with the latch bolt tip extending a first distance from an outer surface of the faceplate in a direction away from the axis of rotation and an actuated configuration wherein in response to a system torque on the input member of the lock assembly the latch bolt tip moves towards the axis of rotation to a retracted position substantially flush with the outer surface of the faceplate, the protuberance of the latch member contacting the concave portion of the outer perimeter of the cam as the latch bolt moves from the extended position to the retracted position, the latch drive system moves the latch bolt from the extended position to the retracted position when the cam is rotated about the axis of rotation through a first angle of up to about 21 degrees;

wherein the protuberance of the latch member contacts the outer perimeter of the cam throughout the rotation of the cam through the first angle.

31. A latch system adapted to be drivingly connected to an input member of a lock assembly, the latch system comprising:

a latch bolt housing defining an axis of reciprocation;

a faceplate coupled to the latch bolt housing, the faceplate having a latch bolt opening which intersects the axis of reciprocation;

a latch bolt having a latch bolt tip, the latch bolt being moveably disposed in the latch bolt housing for reciprocating movement along the axis of reciprocation; and a latch drive system adapted to couple the input member of the lock assembly to the latch bolt to move the latch bolt along the axis of reciprocation, the latch drive system including:

a cam adapted to be connected for rotation with the input member, the cam rotating about an axis of rotation, the cam having an outer perimeter including a concave portion, a latch member disposed for reciprocating movement along the axis of reciprocation, the latch member including at least one protuberance positioned to be engaged with the cam, a drive member disposed in the latch bolt housing, the drive member having a convex portion arranged to be engaged by a portion of the latch member to pivot the drive member relative to the latch bolt housing against a protuberance formed on an interior surface of the latch bolt housing, the portion of the latch member being positioned between the drive member and the faceplate, and a latch bolt extension coupled to the latch bolt, the latch bolt extension having an arm positioned to be engaged by the drive member;

the latch system having a rest configuration wherein the latch bolt is positioned in a fully extended position with the latch bolt tip extending a first distance from an outer surface of the faceplate in a direction away from the axis of rotation and an actuated configuration wherein in response to a system torque on the input member of the lock assembly the latch bolt tip moves towards the axis of rotation to a retracted position substantially flush with the outer surface of the faceplate, the protuberance of the latch member contacting the concave portion of the outer perimeter of the cam as the latch bolt moves from the extended position to the retracted position, the latch drive system moves the latch bolt from the extended position to the retracted position when the cam is rotated about the axis of rotation through a first angle of up to about 21 degrees;

wherein the cam includes a cam aperture having a cam aperture perimeter surrounding the axis of rotation, the cam aperture having a cam rotation radius, the concave portion of the outer perimeter of the cam having a constant cam radius, a ratio of the cam radius of the concave portion of the outer perimeter of the cam to the cam rotation radius is at least 85%.

32. The latch system of claim 31, wherein the ratio of the cam radius of the concave portion of the outer perimeter of the cam to the cam rotation radius is at least 90%.

33. The latch system of claim 31, wherein the ratio of the cam radius of the concave portion of the outer perimeter of the cam to the cam rotation radius is about 100%.

* * * * *